US011484114B2

(12) United States Patent
Fritz et al.

(10) Patent No.: US 11,484,114 B2
(45) Date of Patent: Nov. 1, 2022

(54) TUFT-PICKING DEVICE, BRUSH-MAKING MACHINE, METHOD FOR PRODUCING A TUFT PICKER AND METHOD FOR PRODUCING A COUNTER PIECE OF A TUFT-PICKING DEVICE

(71) Applicant: Zahoransky AG, Todtnau (DE)

(72) Inventors: Harald Fritz, Todtnau (DE); Robert Steinebrunner, Todtnau (DE); Ingo Kumpf, Todtnau-Schlechtnau (DE)

(73) Assignee: ZAHORANSKY AG, Todtnau (DE)

( * ) Notice: Subject to any disclaimer, the term of this patent is extended or adjusted under 35 U.S.C. 154(b) by 713 days.

(21) Appl. No.: 16/326,016

(22) PCT Filed: Aug. 16, 2017

(86) PCT No.: PCT/EP2017/000985

§ 371 (c)(1),
(2) Date: Feb. 15, 2019

(87) PCT Pub. No.: WO2018/054516

PCT Pub. Date: Mar. 29, 2018

(65) Prior Publication Data

US 2021/0330069 A1 Oct. 28, 2021

(30) Foreign Application Priority Data

Sep. 21, 2016 (DE) ..... 102016011337.5

(51) Int. Cl.

| | |
|---|---|
| ***A46D 3/04*** | (2006.01) |
| ***A46D 1/08*** | (2006.01) |
| ***A46D 3/08*** | (2006.01) |

(52) U.S. Cl.
CPC ..... *A46D 3/042* (2013.01); *A46D 1/08* (2013.01); *A46D 3/082* (2013.01)

(58) Field of Classification Search
CPC ..... A46D 1/08; A46D 3/042; A46D 3/082
See application file for complete search history.

(56) References Cited

U.S. PATENT DOCUMENTS

| | | | |
|---|---|---|---|
| 5,344,218 | A | 9/1994 | Weihrauch |
| 10,517,389 | B2 | 12/2019 | Birk |

(Continued)

FOREIGN PATENT DOCUMENTS

| | | |
|---|---|---|
| CN | 201468429 | 5/2010 |
| CN | 102626274 | 8/2012 |

(Continued)

*Primary Examiner* — Randall E Chin
(74) *Attorney, Agent, or Firm* — Volpe Koenig

(57) ABSTRACT

To improve the brush-making field, a tuft-picking device (4) is provided, which includes the tuft picker (8) that is movable in relation to the material box (2) of the brush-making machine (1) and, on its front side (11), which in the operating position faces the bristle supply (3) held in the material box (2), includes at least one tuft-picking notch (12). The tuft-picking notch (12) has two opposing knife edges (14, 15), which delimit the notch opening (13) of the tuft-picking notch (12) and are oriented transverse to the direction of movement of the tuft picker (8). Another part of the tuft-picking device (4) is the counter piece (9), which is provided with the separating edge (17) facing the tuft picker (8). In order to allow bristle filaments (16) to be removed from the bristle supply (4) as gently as possible, at least one of the two knife edges (14, 15) and/or the separating edge (17) is rounded.

13 Claims, 14 Drawing Sheets

(56) References Cited

U.S. PATENT DOCUMENTS

| | | | | |
|---|---|---|---|---|
| 2017/0065072 | A1* | 3/2017 | Alinski | A46D 1/0238 |
| 2017/0065073 | A1* | 3/2017 | Alinski | A46D 3/042 |

FOREIGN PATENT DOCUMENTS

| | | | |
|---|---|---|---|
| CN | 102834032 | | 12/2012 |
| CN | 105705061 | | 6/2016 |
| DE | 29907810 | | 7/1999 |
| DE | 102006041466 | A1 | 3/2008 |
| DE | 102013008842 | | 12/2014 |
| EP | 0433470 | | 6/1991 |
| JP | 2011115500 | A | 6/2011 |
| WO | 2015185721 | | 12/2015 |

* cited by examiner

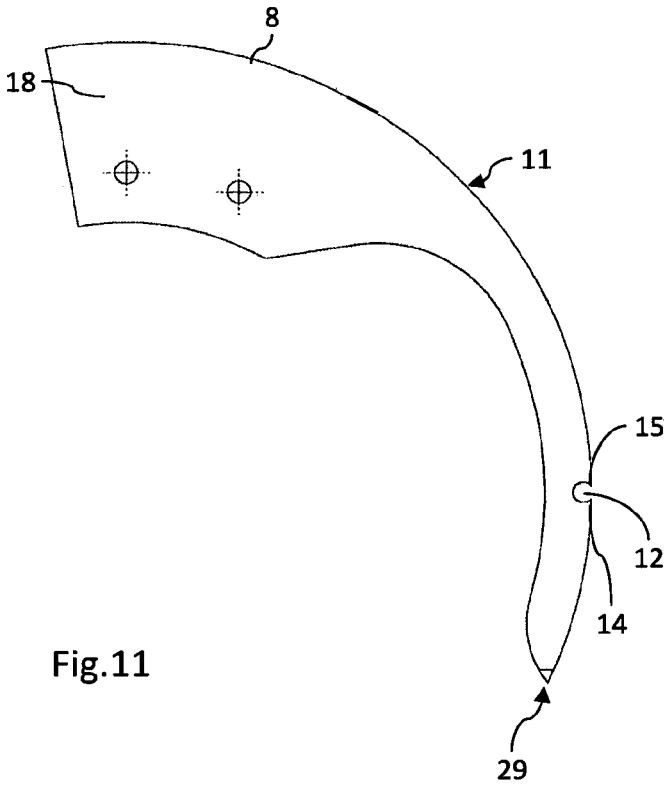
Fig.11
Fig.12
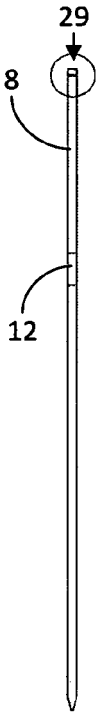
Fig.14
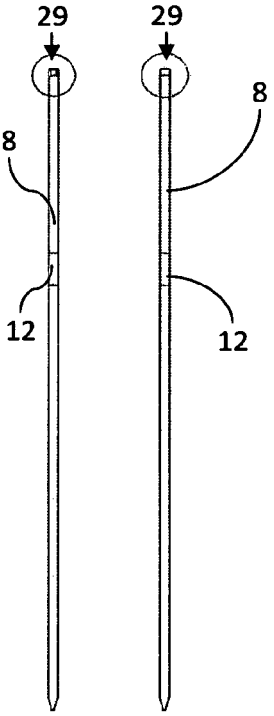
Fig.13
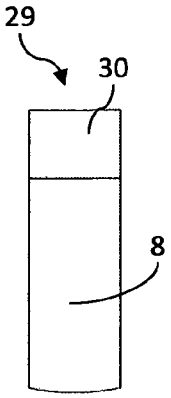
Fig. 12A
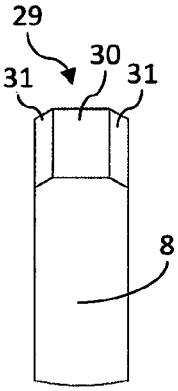
Fig. 13A
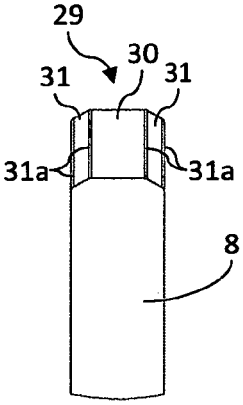
Fig. 14A

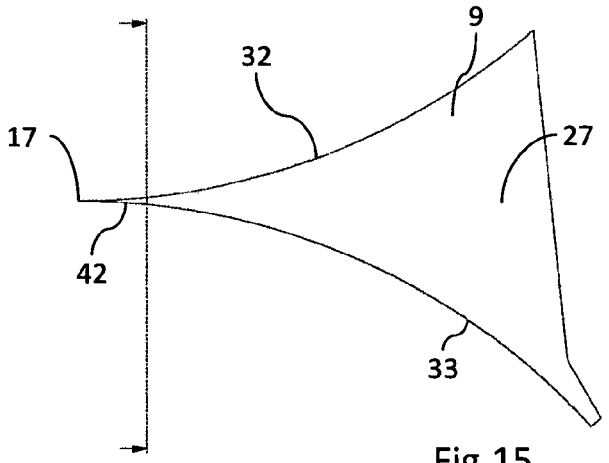
Fig.15
Fig.16
Fig.18
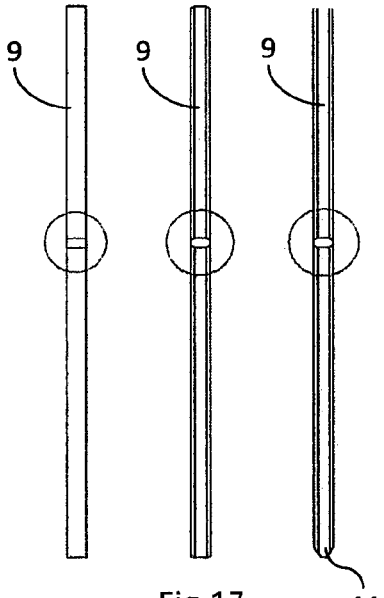
Fig.17
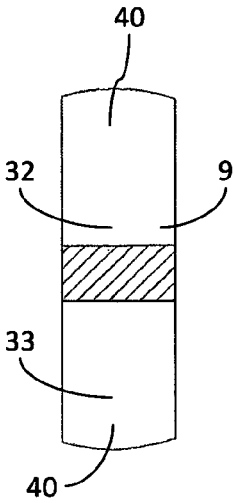
Fig. 16A
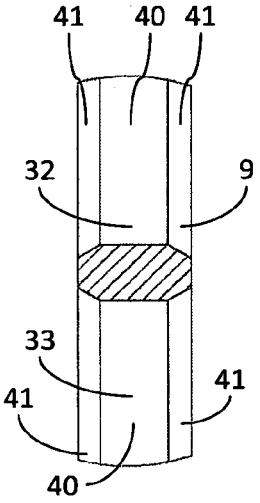
Fig. 17A
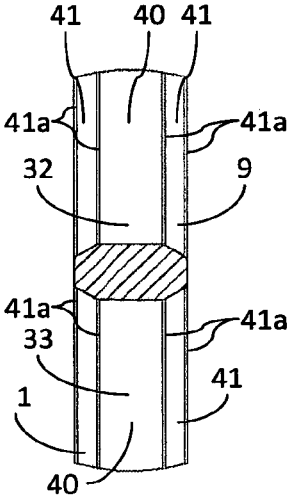
Fig. 18A

TUFT-PICKING DEVICE, BRUSH-MAKING MACHINE, METHOD FOR PRODUCING A TUFT PICKER AND METHOD FOR PRODUCING A COUNTER PIECE OF A TUFT-PICKING DEVICE

FIELD OF THE INVENTION

The invention relates to tuft-picking devices for brush-making machines. Each of the tuft-picking devices comprises a tuft picker that is movable relative to a material box, and a counter piece that is stationary relative to the movable tuft picker, wherein the tuft picker on the front side thereof that in the use position faces a bristle supply kept ready in the material box has at least one tuft-picking notch and for picking a bristle tuft from the bristle supply and for dispensing a received bristle tuft to the brush-making machine by way of the at least one tuft-picking notch is movable past the bristle supply and past the counter piece at least up to a dispensing position, wherein the tuft-picking notch has two mutually opposite blade edges that delimit a notch opening of the tuft-picking notch and are oriented transversely to the direction of movement of the tuft picker, and the counter piece has a separation edge that faces the tuft picker.

The invention moreover relates to a brush-making machine having a material box for supplying a bristle supply, and having a tuft-picking device which has at least one tuft picker for retrieving bristle tufts from the material box.

The invention moreover also relates to methods for producing a tuft picker and to methods for producing a counter piece of a tuft-picking device.

BACKGROUND

Tuft-picking devices, brush-making machines, methods for producing a tuft picker as well as methods for producing a counter piece of a tuft-picking device of this type are known in various embodiments from the prior art.

When separating or retrieving bristles, which are also referred to as filaments, from a material box, which in general can also be referred to as a supply container for bristles, filaments, or bristle filaments that are cut to a specific length, individual bristles are retrieved from the material box by way of a so-called tuft-picking notch as a tuft picker moves past. As soon as the tuft picker by way of the tuft-picking notch departs from the retrieving region in front of the material box, the tuft-picking notch is closed with the aid of a so-called counter piece such that a tuft from a defined number of individual bristle filaments or bristles that is disposed in the tuft-picking notch is securely disposed in the tuft-picking notch. Said bristle tuft with the aid of the tuft picker is then conveyed to a next operating step. It can be provided herein that the bristle tuft is fed to a stuffing tool of a brush-making machine and with the aid of said stuffing tool is anchored conjointly with a wire anchor in a brush body.

In the case of another type of brush making it is provided that the bristle tuft with the aid of the tuft picker is fed to a tool which deposits the bristle tuft in a defined manner in a cartridge or another container. However, it is also possible for the bristle tuft that is disposed in the tuft-picking notch to be retrieved from the tuft-picking notch with the aid of a suction device and to be fed to a cartridge or another container. A procedure of this type is often used in the context of the so-called anchor-less production of brushes.

In the case of conventional brush-making machines the bristle tufts are composed of individual round bristle filaments which are cut at both ends. The tufts with the aid of a tuft picker and a counter piece of a tuft-picking device are retrieved from the material box of the brush-making machine, folded in the center by way of a stuffing tool, and by way of an ankle wire are stuffed into a brush body or a toothbrush body. After stuffing, the ends of the tufts are cut to a specific length or to a specific profile with a milling tool. The ends of the bristle tufts are subsequently rounded by way of a plurality of grinding procedures. When separating the bristle tufts from the material box and when introducing the bristle tufts into the brush body, a distortion can arise in individual bristle tufts or else only individual bristle filaments. Distortion in this context means that the bristle tuft or individual bristle filaments in the bristle tuft are unilaterally displaced and after the stuffing procedure can thus project upwards from the bristle field of the produced brush, for example. In the case of brush-making machines previously known from the prior art this is remedied by way of subsequent milling and grinding of the bristle field.

If more sophisticated bristle material is to be used in processing, thus bristle filaments of which the ends are pretreated and which after separating from the material box do not permit any further machining of the filament ends thereof, for example, there can exist higher requirements in terms of quality and precision pertaining to retrieving and feeding the bristle tufts by the tuft picker. These particular requirements resulting in particular in the processing of pre-rounded bristle filaments, chemically and/or mechanically sharpened bristle filaments and also bristle filaments of which the bristle ends are provided with markings. The retrieval of the bristle filaments from the material box and the feeding to the downstream processing steps is particularly demanding also in the case of bristle filaments which are not round, thus for example such which have a square, or polygonal, x-shaped or else hollow cross section.

The tuft picker having the tuft-picking notch is often guided past the material box by way of a stroke and a return stroke between two reversal points. The tuft-picking notch in the case of the return stroke is empty and can already be filled with bristle filaments after the counter piece has passed the material box. After a fresh reversal of the movement, the tuft-picking notch again meets the counter piece and herein passes a so-called separation edge which is configured on the counter piece and faces the tuft picker.

The closing of the tuft-picking notch starts at this moment, in that the tuft-picking notch slides past the separation edge of the counter piece and is thus obscured by a picker side of the counter piece that faces the tuft picker, said tuft-picking notch thus being closed. The bristle filaments in the tuft-picking notch are finally separated from those bristle filaments in the material box when the tuft-picking notch is being closed. Many bristle filaments are again forced along a counter piece tip on which the separation edge of the counter piece is configured back into the material box. Many bristle filaments are retained in the tuft-picking notch. When the tuft-picking notch is being closed by the counter piece it can now arise that individual bristle filaments are damaged. There is the risk herein that damaged elements are forced back into the material box or else remain in the tuft-picking notch.

It can thus arise that damaged bristle filaments are processed, or else the bristle filaments that have been forced back into the material box are retrieved at a later point in time from the material box by the tuft-picking notch and are then fed to the subsequent processing steps.

The processing of damaged bristle filaments can trigger consequential faults which can even go so far that said consequential faults can lead to finished produced brushes being rejected. Many of the damaged bristle filaments can have a kink and in this instance project laterally from the bristle tuft. Many filaments are distorted and project upward from the bristle field of the produced brush. In particular in the case of toothbrushes, it can arise in the processing of damaged bristle filaments that the latter fall out and are potentially even swallowed while brushing teeth.

SUMMARY

It is therefore an object of the invention of providing a tuft-picking device, a brush-making machine, as well as methods for producing tuft pickers and counter pieces of tuft-picking devices of the type defined at the outset, by way of which the above-outlined disadvantages of the tuft-picking devices and brush-making machines known from the prior art can be minimized or even avoided.

This object in the case of a tuft-picking device of the type mentioned at the outset is achieved by the features of a respective independent claim and in particular in that at least one of the two blade edges and/or the separation edge in a manner transverse to the longitudinal extent thereof is/are rounded.

It has indeed been demonstrated that the geometry of the edges that interact in the separation of bristle tufts from the bristle supply of the material box, specifically at least one blade edge of the tuft picker, on the one hand, and the separation edge of the counter piece, on the other hand, play a decisive part a significant part in the damage-limited or even damage-free retrieval of bristle filaments from the material box. The risk that damage to individual bristle filaments arises in the retrieval of the bristle filaments from the material box in that said bristle filaments are jammed between the interacting edges can be reduced by rounding at least one of the edges that interact in the retrieval in the region of the tuft-picking notch. The afore-described consequential faults can thus be minimized or even avoided.

Since the tuft picker by way of the two blade edges thereof for retrieving bristle bundles from the material box and for transporting the retrieved bristle tufts to a downstream processing step is moved past the separation edge of the counter piece by way of only a minor spacing, the blade edges of the separation edge also approach the point of a very minor spacing. The bristle filaments can more carefully retrieved due to the afore-described rounded feature. In particular when the bristle filaments are in danger of being jammed between the separation edge and one of the blade edges the rounded feature of the respective edge can lead to the respective bristle filament being either pushed in a comparatively gentle manner into the tuft-picking notch or else, in a likewise gentle manner, being conveyed back into the material box.

It can be particularly advantageous herein when at least one blade edge of the two blade edges is rounded, said blade edge in the transportation direction of the bristle tufts to the dispensing position thereof in a downstream processing step being the rear blade edge. However, both blade edges and/or else the separation edge can also be rounded. In this way, bristle tufts can bristle tufts can be carefully retrieved from the material box not only in the case of a stroke of the tuft picker in the direction of the dispensing position. The careful retrieval can thus also be possible in the case of a return stroke of the tuft picker.

It is possible that the at least one blade edge and/or the separation edge is/are in each case rounded transversely to the longitudinal extent of said edges by way of a radius. The radius or the radii of the at least one blade edge and/or of the separation edge herein can be between 0.005 millimeters and 0.03 millimeters, particularly preferably between 0.005 millimeters and 0.02 millimeters.

Since the quality of the interacting surfaces can also be of importance in the careful picking of bristle tufts from the material box, it can be advantageous when a surface of the at least one blade edge and/or a surface of the separation edge is/are smoothed. The afore-mentioned surfaces can advantageously have a mean roughness value or surface roughness value of Ra<0.1, or even Ra<0.05, and particularly preferably of Ra<0.02. In this way, particularly smooth edge faces on which the bristle filaments can slide in a particularly easy manner in the direction of the tuft-picking notch or else back into the material box without being damaged, distorted, or kinked are generated.

In order for the object to be achieved, a tuft-picking device of the type mentioned at the outset having one or more features of the invention is also provided. Accordingly, it is in particular provided that a length of at least one blade edge of the tuft-picking device is smaller than a height of the tuft-picking notch measured transversely to the direction of movement of the tuft picker. In this way, a length on which the bristle filaments can be jammed and damaged between the blade edge and the separation edge on the counter piece can be reduced. The length of the at least one blade edge herein can be shorter than a length of bristle filaments that are to be a retrieved by the tuft-picking device.

It is to be mentioned that this feature can also be combined with the features described above in the context of a tuft-picking device according to the invention.

In order for the danger of damage to individual bristle filaments in the retrieval thereof from the material box with the aid of the tuft-picking notch to be able to be further reduced, a blade edge chamfer and/or a blade edge arc can be configured between a flat side of the tuft picker that is oriented transversely to the longitudinal axis of the tuft-picking notch and the at least one blade edge. Due to this a length of the blade edge can be delimited. However, it is also possible that at least one blade edge chamfer and/or at least one blade edge arc are/is respectively configured between each of the two flat sides of the tuft picker that are oriented transversely to the longitudinal axis of the tuft-picking notch and the at least one blade edge. All this leads to the at least one blade edge being disposed between at least two blade edge chamfers and/or blade edge arcs, due to which a length of the at least one blade edge can be smaller than a height of the tuft-picking notch measured transversely to the direction of movement of the tuft picker.

In this way, a length of the blade edge can also be reduced and be smaller than a height of the tuft-picking notch measured transversely to the direction of movement of the tuft picker. Moreover, the blade edge here can be disposed symmetrically between the at least two blade edge chamfers or blade edge arcs.

The tuft-picking notch, at least adjacent to one of the two blade edges, in particular adjacent to the blade edge that in the transportation direction of the bristle tufts to the dispensing position thereof is the rear blade edge, can have a flattened run-in ramp into the tuft-picking notch. It can be provided herein that the run-in ramp, proceeding from the blade edge, ascends, that the run-in ramp, proceeding from the blade edge, in the profile of said run-in ramp thus has an increasing material thickness and, adjacent to the blade edge, thus has a smaller thickness than in a region of the run-in ramp that faces away from the blade edge.

It can also be advantageous when at least one notch edge of the tuft-picking notch that is oriented transversely or orthogonally to a longitudinal central axis of the tuft-picking notch is rounded. The at least one notch edge herein can be rounded by way of a notch edge radius, specifically preferably by way of a notch edge radius having a length between 0.005 millimeters and 0.03 millimeters.

In order for the object to be achieved a tuft-picking device of the type mentioned at the outset having one or more features of the invention is also provided. Accordingly, it is in particular provided that a length of the separation edge is smaller than a height of the counter piece measured transversely to the direction of movement of the tuft picker and/or is smaller than a height of the tuft-picking notch measured transversely to the direction of movement of the tuft picker.

The length of the separation edge can thus also be shorter than a length of bristle filaments which can be retrieved from the bristle supply by the tuft-picking device.

It is to be mentioned that this feature can also be combined with the features described above in the context of the tuft-picking devices according to the invention.

In the case of one further embodiment of the tuft-picking device according to the invention it can furthermore be provided that the counter piece has at least one separation edge chamfer that is oriented transversely to the longitudinal extent of the separation edge and/or at least one separation edge arc that is oriented transversely to the longitudinal extent of the separation edge, the separation edge in terms of the length thereof being delimited by said separation edge chamfer and/or said separation edge arc.

However, it is also possible that the counter piece has at least two separation edge chamfers that are oriented transversely to the longitudinal extent of the separation edge and/or at least two separation edge arcs that are oriented transversely to the longitudinal extent of the separation edge, the separation edge being disposed between said separation edge chamfers and/or said separation edge arcs. The foregoing being such that a length of the separation edge is smaller than a height of the counter piece measured transversely to the direction of movement of the tuft picker.

The separation edge can be connected to an upper side and/or to a lower side of the counter piece by way of the at least one separation edge chamfer and/or the at least one separation edge arc.

In both cases, due to this a length of the separation edge can be smaller than a height of the counter piece measured transversely to the direction of movement of the tuft picker. These measures, in a manner analogous to attaching blade edge chamfers and/or radii and/or blade edge arcs to the tuft picker in the region of the at least one blade edge also serve for reducing the length of the separation edge. The foregoing with the objective of keeping a length of a clamping region which can be configured between the separation edge and the at least one blade edge of the tuft picker as small as possible and to in this way minimize or even avoid any damage to bristle filaments in the retrieval of bristle filaments from the material box.

In this context it can be advantageous when at least one of the blade edges and/or the separation edge are/is oriented orthogonally to a direction of movement of the tuft picker and/or parallel with an alignment of the bristle tufts to be positioned in the tuft-picking notch. Both the at least one blade edge as well as the separation edge can also be configured on a portion of an arcuate edge or overall be arcuate.

In principle, at least one edge that is oriented transversely or orthogonally to the separation edge can be rounded. A rounded feature of this type can be expedient above all in the case of such edges which can come into contact with bristle filaments. It is also possible that all of the edges of the counter piece are rounded in such a manner. The rounded edges herein can be rounded by way of a radius, preferably by way of a radius having a length of 0.005 millimeters to 0.03 millimeters.

The object is also achieved by a tuft-picking device which has one or more features of the invention. It is in particular provided in the case of a tuft-picking device of the type mentioned at the outset that the tuft picker has an end side which is oriented transversely or even orthogonally to the front side of the tuft picker and which comprises an end face that is delimited by at least one end chamfer and/or by an end radius.

The at least one end chamfer herein can be aligned at an angle of 20° to 80° in relation to the end face of the tuft picker. A chamfer width of the end chamfer can be between 0.05 millimeters and 0.4 millimeters.

It can be advantageous when chamfer edges of the at least one end chamfer are rounded by way of a radius having a length between 0.005 millimeters and 0.03 millimeters.

The object is also achieved by a tuft-picking device which has one or more features of the invention. It is provided in particular in the case of a tuft-picking device of the type mentioned at the outset that a box side of the counter piece that faces the bristle supply, and/or a picker side of the counter piece that faces the tuft picker, have/has at least one lateral chamfer and/or at least one lateral radius, a respective lateral front face of the box side and/or being delimited by said lateral chamfer and/or said lateral radius.

The at least one lateral chamfer on the box side herein can be aligned at an angle of 20° to 80° in relation to a lateral front face of the box side that is adjacent to the lateral chamfer. It is also possible that the at least one lateral chamfer on the picker side of the counter piece is aligned at an angle of 20° to 80° in relation to a lateral front face of the picker side that is adjacent to the lateral chamfer.

The respective lateral chamfer herein can have a chamfer width between 0.05 millimeters and 0.4 millimeters. Chamfer edges of the lateral chamfer can be rounded by way of a radius having a length between 0.005 millimeters and 0.03 millimeters.

In the case of brush-making machines of this type material boxes having two or three or else a plurality of individual bristle magazines are often used, the bristle tufts being able to be retrieved from said bristle magazines with the aid of the tuft picker and of the at least one tuft-picking notch. This is typically performed in that the individual bristle magazines of the material box are sequentially moved to a retrieving position. To this end, the material box can be pivotable about a pivot axis. In order for the pivoting of the material box about the pivot axis thereof to be enabled, it can be advantageous when a counter piece side of the material box that faces the counter piece and tuft picker has a correspondingly curved contour, in particular a contour curved along an arc, by way of which contour said material box can be pivoted past and along the counter piece.

In this context it can be advantageous when a box side of the counter piece that faces the bristle supply is subdivided at least into a first portion and into a second portion. The first portion herein along the longitudinal extent thereof can be bent about a first radius. The second portion along the longitudinal extent thereof can also be bent about a second radius. It is possible that the second radius is larger than the first radius.

In the case of another embodiment of a tuft-picking device according to the invention a box side of the counter piece, for example the box side already mentioned, that faces the bristle supply can be subdivided at least into a first portion, the separation edge being disposed on the one free end of said first portion, and into a second portion. The first portion herein along the longitudinal extent thereof can be bent about a first radius, while the second portion has a straight, thus non-bent, profile.

In order for the production of the counter piece to be facilitated and in particular for a material-saving rounded feature of the separation edge on the counter piece to be enabled, it can be advantageous in this context when the first radius is bent in the direction counter to the second radius, thus for example being bent away from the material box and the bristle supply. The separation edge in this instance can be disposed on a free end of the first portion of the counter piece.

In the case of a conventional variant of the counter piece it is provided that the separation edge is formed from two tangentially converging radii, specifically a radius that faces the material box and a radius that faces the tuft picker. Were the separation edge to be rounded herein, this rounding would be associated with a relatively large loss of material on the counter piece. This means that the separation edge on a counter piece conventionally produced in such a manner is retracted comparatively far due to the rounded feature, this in consequence requiring a complex adaptation of the geometry of the entire tuft-picking device.

Due to the radius by way of which the first portion of the box side is bent and which is aligned in a negative manner as compared to the radius of the second portion, a desired rounding of the separation edge is possible by way of a lower loss of material. The separation edge herein is created again from the two converging radii of the first portion of the box side of the counter piece, on the one hand, and of the picker side of the counter piece, on the other hand, wherein the radii do not have a tangentially converging profile but rather an intersecting profile, this leading to the more favorable geometric conditions for rounding the separation edges with low losses of material.

In order for the retrieval of bristle filaments from the material box to be designed so as to be even more reliable and gentle, at least one surface of the tuft picker can be smoothed.

Specifically, the following surfaces can be smoothed in such a manner, for example: a surface of at least one or the blades edge radius, of one or the blade edge chamfer, of a blade edge arc, of a notch edge radius, of an end face, of an end chamfer, of an end radius and/or of a chamfer edge of at least one chamfer. Moreover, an internal face of the tuft-picking notch can also be smoothed. The respective smoothed surface can have a mean roughness value or surface roughness value Ra of less than 0.1, of less than 0.05, and particularly preferably of less than 0.02. This can also cause a more gentle processing of bristle filaments.

In analogous manner, the counter piece can also have at least one smoothed surface. The following surfaces of the counter piece can inter alia thus be smoothed: a surface of a separation edge radius, a separation edge chamfer, a separation edge arc, a lateral front face of a box side, a lateral front face of a picker side of the counter piece, a lateral chamfer, a lateral radius and/or at least one chamfer edge of at least one of the chamfers on the counter piece.

A mean roughness value or surface roughness value Ra of the respective smoothed surface herein can be less than 0.1, preferably less than 0.05, particularly preferably less than 0.02.

The smoothing or the extremely smooth design of surfaces of the tuft picker and/or of the counter piece, in particular of the specific afore-mentioned surfaces of the tuft picker and/or of the counter piece which during the retrieval procedure can come into direct contact with bristle filaments can facilitate a retrieval or a separation procedure of bristle filaments from the bristle supply into the material box. This holds true above all when separating a last bristle filament from the bristle supply and/or when at least one blade edge on the tuft-picking notch and/or the separation edge of the counter piece are/is rounded.

On the picker side, the counter piece in a region which is disposed so as to be adjacent to a dispensing position of the bristle filaments to a downstream processing step, in particular to a stuffing tool, can be provided on one side or else on both sides with a run-in chamfer into a tool.

The tuft-picking notch of the tuft picker can be an adjustable tuft-picking notch. In order for the tuft-picking notch to be adjusted, the tuft-picking device can moreover have an adjustment device by way of which a notch depth of the tuft-picking notch can be modified if required. By way of said adjustment device a notch geometry of the tuft-picking notch can optionally also be modified, and/or a bristle tuft positioned in the tuft picker can be ejected from the tuft-picking notch.

The at least one tuft-picking notch, and/or the at least one blade edge, and/or the separation edge, and/or at least one chamfer on the tuft picker and/or on the tuft-picking notch and/or on the counter piece can be produced in a particularly efficient manner and at a satisfactory quality by HSC milling and/or HSC grinding.

Smoothed surfaces of the tuft picker and/or of the counter piece can be produced by polishing. Moreover, at least one at least one blade edge radius of the at least one blade edge, a separation edge radius of the separation edge, and/or at least one the radius on a chamfer edge of at least one chamfer on the tuft picker and/or on the counter piece can also be produced and/or post-machined by polishing.

Potential methods to be used herein are inter alia friction grinding, flow grinding, plasma polishing, drag grinding, drag finishing, and/or manual polishing and/or electrochemical deburring. It is possible herein for the afore-listed surfaces or else radii and arcs to be produced by only one of the afore-mentioned methods or else by a plurality of successively carried out methods.

In the case of one particularly advantageous embodiment of the tuft-picking device according to the invention the tuft picker can be an arcuate separator that is pivotable or rotatable about a pivot axis. It is to be mentioned at this point that arcuate separators can also be referred to as arcuate pickers.

In the case of another variant of the tuft-picking device according to the invention it can also be provided that the tuft picker is a circular tuft-picker disk that is pivotable or rotatable about a pivot axis. Independently of how said tuft picker is designed in specific terms, a plurality of tuft-picking notches optionally having dissimilar notch geometries can also be disposed on the tuft picker, so as to be able to simultaneously retrieve in one stroke a plurality of bristle tufts from the material box.

In particular in the case of the use of tuft pickers which are configured as arcuate separators or as arcuate pickers or as circular tuft-picker disks, it can be expedient when a picker side of the counter piece that faces the tuft picker is bent in a concave manner about the same radius as a front side of the tuft picker that is bent in a convex manner at a specific radius.

It is favorable when the blade edges and/or the separation edges have a length between 0.4 millimeters and 1.4 millimeters and/or have at least one straight portion that is oriented orthogonally to the direction of movement of the tuft picker, for example, having a length between 0.01 millimeters and 0.8 millimeters.

The afore-mentioned object is also achieved by a brush-making machine of the type mentioned at the outset which comprises the means and features of the independent claim directed toward the brush-making machine. The object in the case of a brush-making machine of the type mentioned at the outset is in particular achieved in that the tuft-picking device is one claimed in one of respective claims of the tuft-picking device.

The object is also achieved by a method for producing a tuft picker, in particular a tuft picker of a tuft-picking device having one or more features of the invention. In the case of a method for producing a tuft picker, in particular a tuft picker of a tuft-picking device having one or more features of the invention, it is accordingly in particular provided for achieving the object mentioned at the outset that at least one tuft-picking notch and/or at least one blade edge chamfer and or one blade edge arc and/or an end chamfer and/or an end radius and/or an upper-side and/or lower-side picker notch on the tuft picker and/or a notch edge radius of a tuft-picking notch and/or chamfer edges of at least one chamfer on the tuft picker and/or an internal face of the tuft-picking notch are/is generated by HSC milling and/or HSC grinding.

The object is also achieved by a method in which at least one smoothed surface of the tuft picker is/are produced and/or post-machined by grinding and/or polishing. This method herein can optionally be combined with the afore-defined method steps.

A surface of at least one blade edge radius, of a blade edge chamfer, of a blade edge arc, of a notch edge radius, of an end face, of an end chamfer, of an end radius, of a chamfer edge of at least one chamfer and/or an internal face of the tuft-picking notch herein can be produced and/or post-machined by grinding and/or polishing.

In the case of this method it can furthermore be provided that the production or post-machining of at least one surface and/or of the end face of the tuft picker and/or of at least one radius on the tuft picker, in particular on a blade edge of at least one tuft-picking notch of the tuft picker and/or of at least one chamfer on the tuft picker, in particular on a blade edge of a tuft-picking notch of the tuft picker and/or of an internal face of at least one tuft-picking notch is performed by friction grinding, flow grinding, plasma polishing, drag grinding, drag finishing and/or by manual polishing and/or by electrochemical deburring.

Wet and/or dry granules, porcelain grinding tools, plastics-material grinding tools, ceramic grinding tools, inox chips, copper pins, in particular such which have a diameter of approximately 0.2 millimeters and a length of approximately 1 millimeter, stainless-steel grinding tools, zirconium balls, micro finishing grinding tools, plastics-material grinding tools, wet-grinding pastes, polishing pastes, walnut granules, corn granules and/or dry-grinding granules can be used herein as grinding or polishing means.

The afore-mentioned object is also achieved by a method mentioned at the outset for producing a counter piece which has the means and features of the independent claim directed toward the method for producing a counter piece of a tuft-picking device. In order for the object mentioned to be achieved a method for producing a counter piece of a tuft-picking device, in particular a tuft-picking device with one or more features of the invention is in particular thus also provided, in which at least one smoothed surface of the counter piece is/are produced and/or post-machined by grinding and/or polishing.

For example, the following surfaces can be thus produced and/or post-machined:

the surface of a separation edge radius, of a separation edge chamfer, of a separation edge arc, of a lateral front face, of a lateral chamfer, of a lateral radius and/or at least of a chamfer edge of a chamfer on the counter piece.

The production and/or post-machining herein can be performed by friction grinding, flow grinding, plasma polishing, drag grinding, drag finishing and/or manual polishing and/or electrochemical deburring.

Wet and/or dry granules, porcelain grinding tools, plastics-material grinding tools, ceramic grinding tools, inox chips, copper pins, in particular such which have a diameter of approximately 0.2 millimeters and the length of approximately 1 millimeter, stainless-steel grinding tools, zirconium balls, micro finishing grinding tools, plastics-material grinding tools, wet-grinding pastes, polishing pastes, walnut granules, corn granules and/or dry-grinding granules can be used herein as grinding or polishing means.

High-quality machining results can be reliably achieved by way of a justifiable effort in terms of time by way of friction grinding as the production or post-machining method, in particular when copper pins are used herein as grinding and/or polishing means.

In the case of drag grinding, a plurality of workpieces, thus a plurality of tuft pickers and/or counter pieces, can be fastened to a support and thus be simultaneously machined in one operation. Fine-grain walnut granules can be inter alia used herein as polishing or grinding means, and a machining time can be shortened.

Both the counter piece as well as the tuft picker of the afore-described tuft-picking devices can be composed of hardenable steel, for example HS steel. The steel herein as a blank in the soft state can be produced with an allowance on the end faces. Thereafter, individual contours such as bores and fastening and alignment edges can be produced. The blank of the tuft picker and/or of the counter piece can subsequently be hardened, aligned, and on the respective end side thereof be ground to size. This then is typically the semi-finish product. The method steps described above and discussed and set forth in the claims for producing or completing the tuft picker and/or the counter piece can subsequently be carried out.

BRIEF DESCRIPTION OF THE DRAWINGS

Exemplary embodiments of the invention are described hereunder in more detail by the figures. To some extent in a very schematic illustration:

FIG. 11 shows a plan view of a tuft picker in the form of an arcuate separator, wherein the tuft picker comprises a tuft-picking notch having a smooth surface which has a mean surface roughness Ra of approximately 0.4;

FIG. 12 to FIG. 14 show three lateral views of three dissimilar tuft pickers;

FIG. 12A shows the detail marked by the circle in FIG. 12 in an enlarged illustration, wherein it can be seen that edges on an end face of the end side of the arc are not machined;

FIG. 13A shows the detail marked by the circle in FIG. 13 in an enlarged illustration, wherein it can be seen that an end face of an end side of the tuft picker is provided with two peripheral end chamfers, wherein the end face and the chamfer faces of the end chamfers are smoothed and have a mean surface roughness value Ra of approximately 0.1;

FIG. 14A shows the detail marked by the circle in FIG. 14 in an enlarged illustration, wherein the end face on the end side of the arc herein is provided with peripheral chamfers, the chamfered edges thereof being rounded by way of a radius of 0.005 millimeters to 0.03 millimeters, wherein a surface roughness of the end face and also of the chamfer faces and also of the radii have a mean surface roughness value of Ra<0.05;

FIG. 15 shows a plan view of a counter piece according to the invention;

FIG. 16 shows a first variant of the counter piece illustrated in FIG. 15 in a front view sectioned along the section line illustrated in FIG. 15;

FIG. 17 shows a second front view of a further variant of a counter piece according to the invention, sectioned along the section line illustrated in FIG. 15;

FIG. 18 shows a front view of a third variant of a counter piece according to the invention, sectioned along the section line illustrated in FIG. 15;

FIG. 16A shows the detail marked by the circle in FIG. 16 in an enlarged illustration, wherein it can be seen that none of the edges of the counter piece are machined;

FIG. 17A shows the detail marked by the circle FIG. 17 in an enlarged illustration, wherein it can be seen that both a box side as well as a picker side of the counter piece are in each case provided with lateral chamfers;

FIG. 18A shows the detail marked by the circle in FIG. 18 in an enlarged illustration, wherein it can be seen that a box side and a picker side of the counter piece are provided with peripheral lateral chamfers, wherein chamfer edges of the lateral chamfers are in each case rounded by way of a radius;

DETAILED DESCRIPTION

Figure 1:
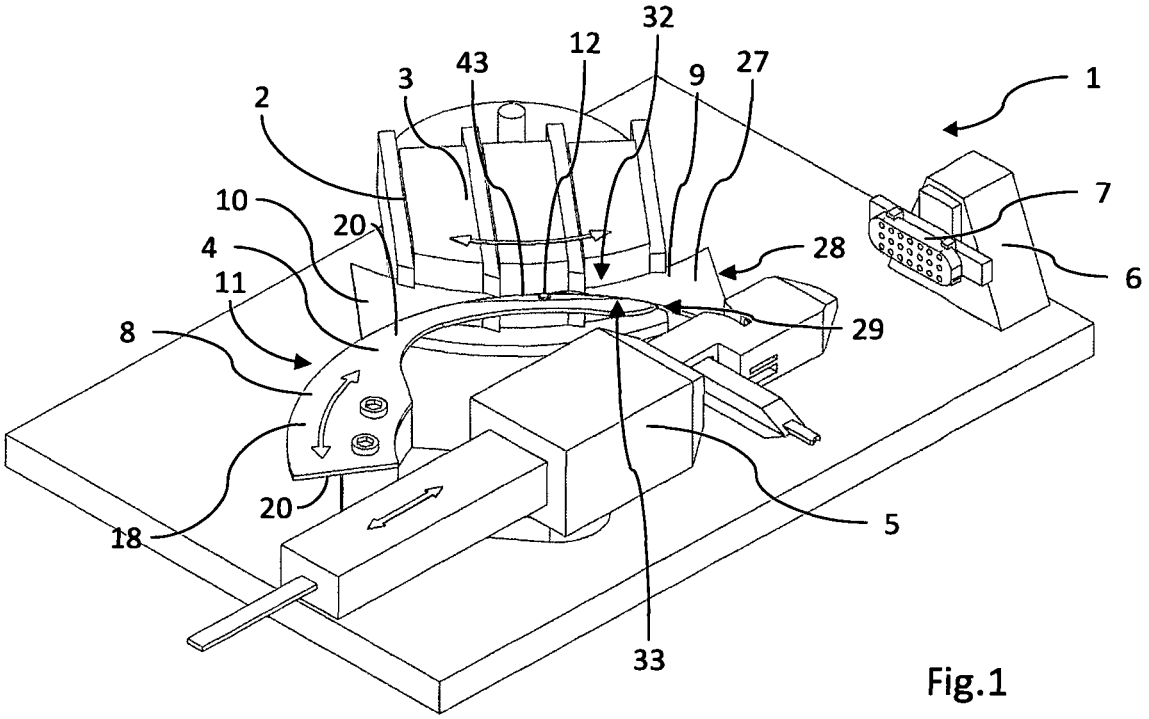
FIG. 1 shows a perspective view of a brush-making machine according to the invention, having a tuft-picking device which has a tuft picker in the form of an arcuate separator that is pivotable about a pivot axis and a stuffing tool.

FIG. 1 shows a brush-making machine that in its entirety is identified by the reference sign 1, having a material box 2 for supplying a bristle supply 3, and having a tuft-picking device 4 which has a tuft picker 8 for retrieving bristle tufts from the material box 2.

The brush-making machine 1 illustrated in FIG. 1 moreover also has a stuffing tool 5. The bristle tufts that with the aid of the tuft-picking device 4 have been retrieved from the material box 2 can be transferred to said stuffing tool 5 for stuffing into a brush body 7 that is kept ready on a corresponding holding device 6.

The brush body 7 with the aid of the holding installation 6 can be moved to the position relative to the stuffing tool 5 that is required for stuffing the bristle tufts.

The tuft-picking device 4 comprises a tuft picker 8 that is movable relative to the material box 2, and a counter piece 9 that is stationary relative to the movable tuft picker 8. Moreover, a material holder 10 which if required can be designed in a manner analogous to the counter piece 9 can be seen on the left side of the material box 2 in FIG. 1.

The tuft picker 8 on the front side 11 thereof that in the use position faces the bristle supply 3 kept ready in the material box 2 has at least one tuft-picking notch 12. For retrieving and singularizing a bristle tuft from the bristle supply 3 and for dispensing a received bristle tuft to the brush-making machine 1, the tuft picker 8 by way of the at least one tuft-picking notch 12 thereof can be moved past the material box 2 and the bristle supply 3 located therein at least up to a dispensing position. The tuft-picking notch 12 has two mutually opposite blade edges 14, 15 which delimit a notch opening 13 of the tuft-picking notch 12 and are oriented transversely to the direction of movement of the tuft picker 8. The counter piece 9 is provided with a separation edge 17 that faces the tuft picker 8.

Figure 6:
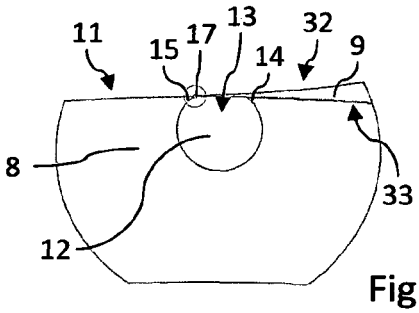
FIG. 6 shows a plan view of a tuft picker according to the invention in a position adjacent to a counter piece having a rounded separation edge.
Figure 6A:
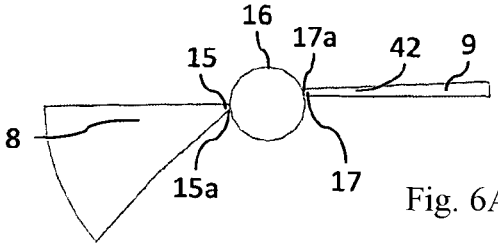
FIG. 6A shows the detail marked by the circle in FIG. 6 in an enlarged illustration, wherein a bristle filament that is disposed between a rounded blade edge of the tuft picker and a rounded separation edge of the counter piece can be seen.

As now is highlighted, for example by FIGS. 6 and 6A, at least one of the two blade edges 14, 15 and the separation edge 17 are rounded transversely to the longitudinal extent thereof. This in order to treat with care individual brush filaments 16 when separating the bristle filaments 16 from the bristle supply 3 of loose bristle filaments 16.

The material box 2 according to FIG. 1 comprises three magazines having in each case one supply of bristle filaments 16. By pivoting the material box 2 about the pivot axis thereof in the direction of the double arrow the individual magazines can be moved to a position relative to the tuft picker 8 that is required for the retrieval of bristle filaments 16.

Figure 5:
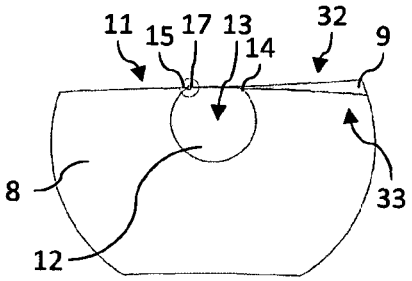
FIG. 5 shows a plan view of a conventional tuft picker in a position adjacent to a sharply tapered counter piece on which a sharp separation edge is configured.
Figure 5A:
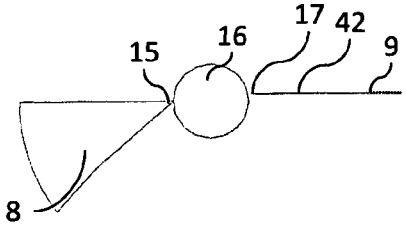
FIG. 5A shows the detail marked by the circle in FIG. 5 in an enlarged illustration, wherein a bristle filament that is disposed between a sharp blade edge and a sharp separation edge can be seen.

FIGS. 5 and 5A show a tuft picker 8 and a corresponding counter piece 9 as known from the prior art. It can be readily seen according to FIG. 5A that both the blade edge 15 illustrated therein as well as the separation edge 17 illustrated therein converge in a tip, thus converging a sharp manner, due to which a bristle filament 16 that is disposed therebetween could be damaged when retrieved from the material box 2.

According to FIGS. 6 and 6A the blade edge 15 of the two blade edges 14, 15, in the transportation direction of the bristle tufts to the dispensing position, is the rear blade edge 15 and is rounded.

The blade edge 15 herein is provided with and rounded by way of a blade edge radius 15*a*, and the rounded separation edge 17 is provided with and rounded by way of a separation edge radius 17*a*. The blade edge radius 15*a* and the separation edge radius 17*a* are in each case oriented transversely to the longitudinal extent of the blade edges 14 and 15 and also of the separation edge 17.

Said radii 15*a* and 17*a* by way of which the blade edges 14 and/or 15 and the separation edge 17 are rounded herein can have a length between 0.005 millimeters and 0.03 millimeters, particularly preferably between 0.0005 and 0.02 millimeters.

It is worth noting that a surface of the rounded blade edges 14, 15 and a surface of the rounded separation edge 17 are smoothed.

The smoothed surfaces of the blade edges 14, 15 and of the separation edge 17 herein can have a mean roughness value or a surface roughness value of $Ra<0.1$, preferably of $Ra<0.05$, particularly preferably of $Ra<0.02$.

Figure 40:
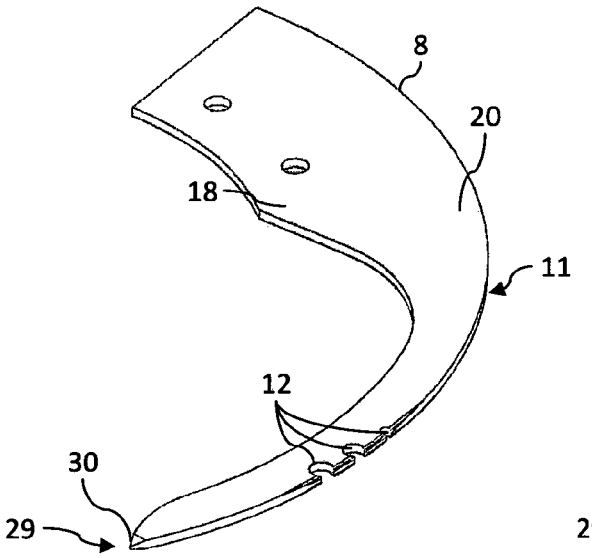
FIG. 40 shows a perspective view of a tuft picker according to the invention in the form of an arcuate separator having a total of three tuft-picking notches designed in different sizes, the blade edges thereof in terms of the lengths thereof being delimited by dissimilar blade edge chamfers and blade edge arcs.
Figure 41:
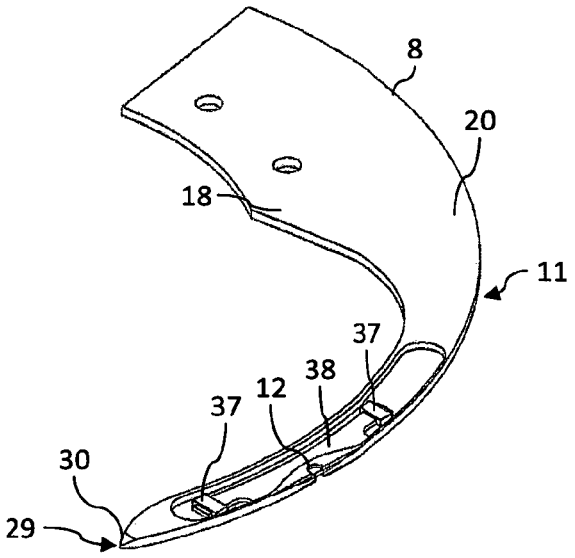
FIG. 41 shows a perspective view of a tuft picker according to the invention in the form of an arcuate separator having an arcuate notch that is adjustable in terms of the depth and in terms of the cross section thereof.
Figure 42:
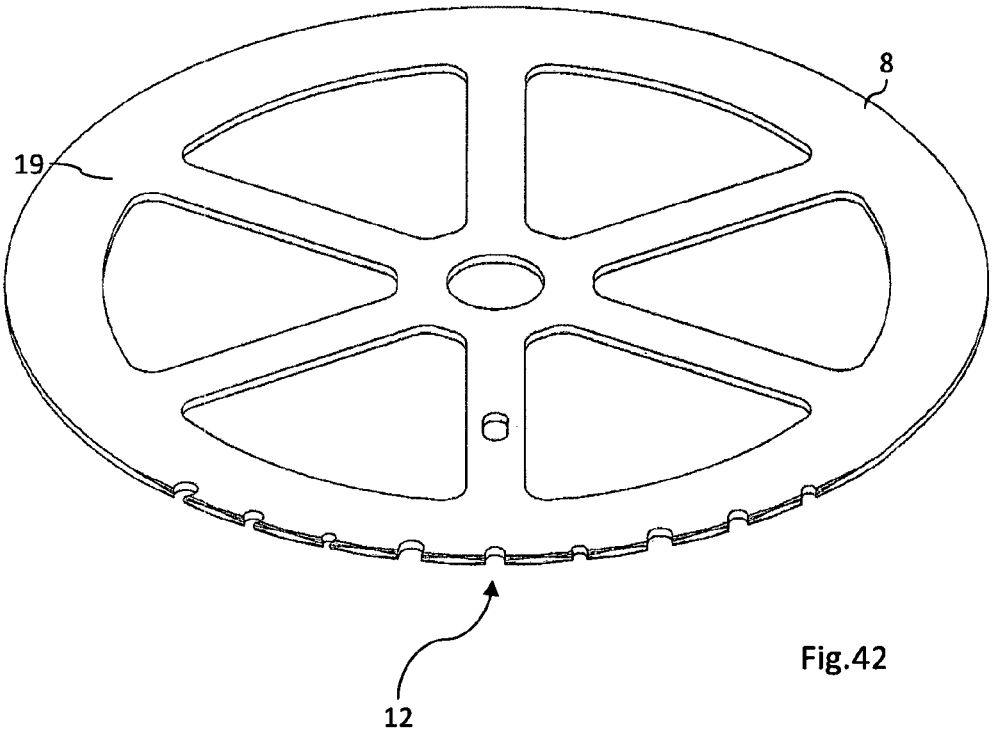
FIG. 42 shows a perspective view of a circular tuft-picker disk which is provided with a plurality of tuft-picking notches, wherein the left three tuft-picking notches are standard tuft-picking notches, wherein the central three tuft-picking notches are ones having a parallel exit, wherein an exit direction is axially oriented, and wherein the right three tuft-picking notches are ones having a parallel exit, wherein the exit directions are oriented so as to be mutually parallel, wherein all of the notches can be configured according to one of the variants illustrated in FIGS. 23 to 39.

According to FIGS. 1, 40 and 41 the tuft picker 8 is an arcuate separator 18 which is pivotable or rotatable, respectively about a pivot axis, and which can also be referred to as an arcuate picker, or is a circular tuft-picker disk 19 that is pivotable or rotatable about a pivot axis.

FIGS. 2 to 4A and FIGS. 24 to 39 show that a length of at least one of the blade edges 14, 15 is smaller than a maximum height of the tuft-picking notch 12 measured transversely to the direction of movement of the tuft picker 8.

In order for the length of the blade edges 14, 15 to be reduced, and depending on the exemplary embodiment of the tuft-picking notch 12 according to the invention, a blade edge chamfer 21 and/or a blade edge arc 22 can herein be configured between a flat side 20 of the tuft picker 8 that is oriented transversely to the longitudinal axis of the tuft-picking notch 12 and the respective blade edge 14, 15. The length of the blade edges 14 and/or 15 can be delimited by attaching blade edge chamfers 21 of this type and/or blade edge arcs 22 of this type, this facilitating a more gentle retrieval of bristle filaments 16 from the bristle supply 3 in the material box 2 of the brush-making machine 1.

In the case of some exemplary embodiments of the tuft-picking notch 12 according to the invention, for example FIGS. 4A, 5A, 35, 36, 40, it is provided that in each case at least one blade edge chamfer 21 and/or at least one blade edge arc 22 in the form of a comparatively large radius is configured between both flat sides 20 of the tuft picker 8 that are oriented transversely to the longitudinal axis of the tuft-picking notch 12 and the at least one blade edge 14, 15, such that the respective blade edge 14, 15 is disposed between at least two blade edge chamfers 21 and/or between at least two blade edge arcs 22. A length of the respective blade edge 14, 15 is also reduced due to this and in this instance is thus smaller than a maximum height of the tuft-picking notch 12 measured transversely to the direction of movement of the tuft picker 8, and also smaller than a length of the bristle filaments 16. Any conceivable combination of blade edge chamfers 21 and blade edge arcs 22 is possible herein if required, either on only one side of the respective blade edge 14, 15 or else on both sides of the blade edges 14, 15.

Figure 4:
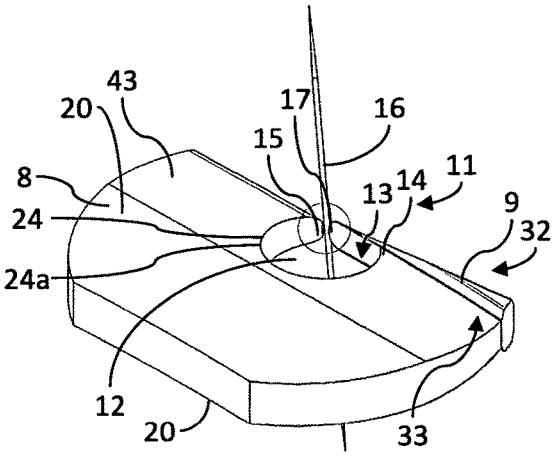
FIG. 4 shows a further perspective view of a third embodiment according to the invention of a tuft-picking device.
Figure 4A:
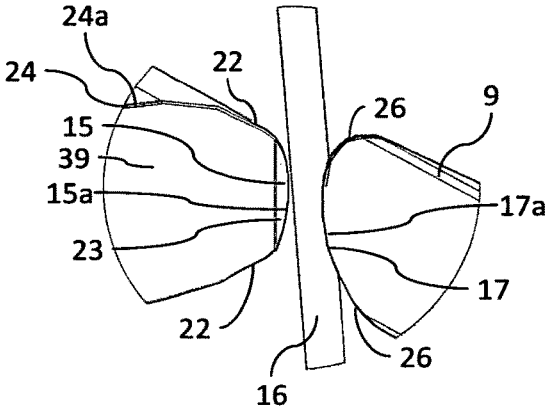
FIG. 4A shows the detail marked by the circle in FIG. 4 in an enlarged illustration, wherein it can be seen that an upper-side and a lower-side picker chamfer in each case are joined by a blade edge arc which open into the blade edge.

FIGS. 4 and 4A show a further detail of the tuft-picking device 4 according to the invention which enables a gentle retrieval of bristle filaments 16 from the bristle supply 3. It can be seen here that the tuft-picking notch 12, at least adjacent to one of the two blade edges 14, 15, has a flattened run-in ramp 23 into the tuft-picking notch 12.

According to the exemplary embodiments of the tuft picker 8 such as the latter is illustrated in FIGS. 4 and 4A and also in some of FIGS. 23 to 39, notch edges 24 of the tuft-picking notch 12 that are oriented transversely or orthogonally, respectively, to a longitudinal central axis of the tuft-picking notch 12 are also rounded by way of a notch edge radius 24*a* which preferably has a length between 0.005 millimeters and 0.03 millimeters.

Figure 19:
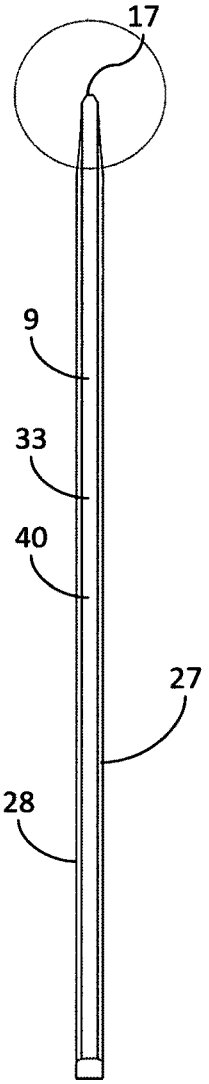
FIG. 19 shows a lateral view of a further counter piece according to the invention, wherein a separation edge can be seen on a tip of the counter piece.
Figure 20:
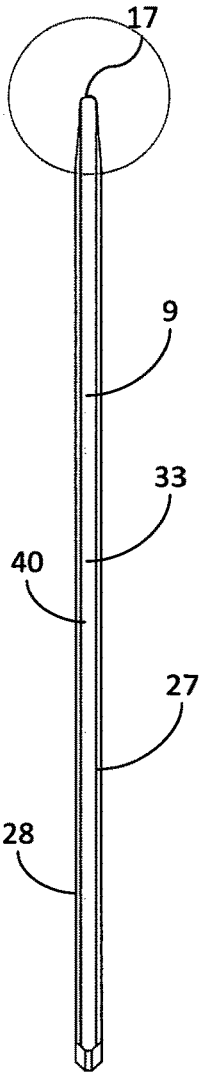
FIG. 20 shows a side view of a further counter piece according to the invention, wherein a separation edge can be seen on a tip of the counter piece.
Figure 20A:
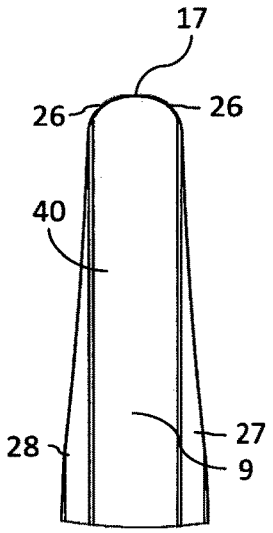
FIG. 20A shows the detail marked by the circle in FIG. 20 in an enlarged illustration, wherein it can be seen that the separation edge is delimited by two separation edge arcs.
Figure 21:
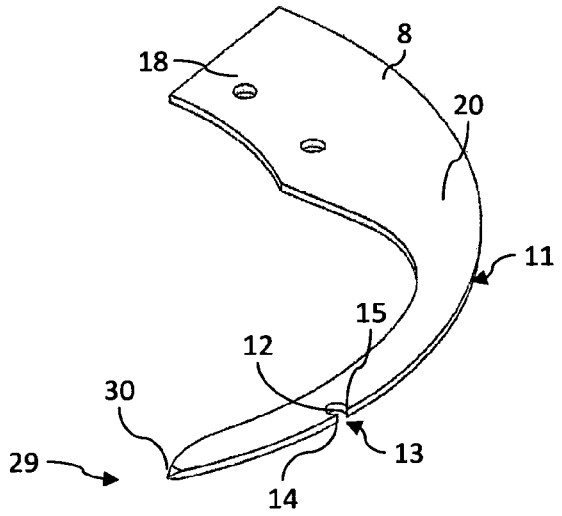
Fig.21 (Prior Art)
FIG. 21 shows a perspective view of a tuft picker in the form of an arcuate separator, known from the prior art.
Figure 22:
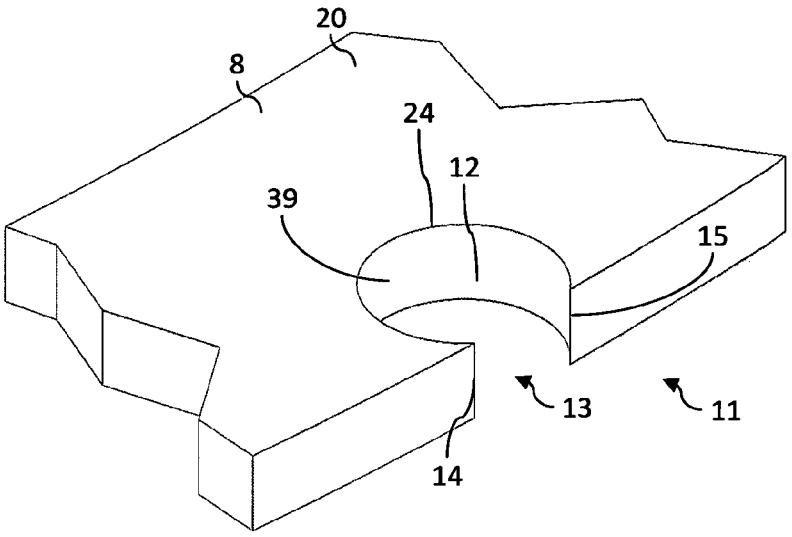
Fig.22 (Prior Art)
FIG. 22 shows an enlarged illustration of a tuft-picking notch without chamfers and without radii, known from the prior art.

When viewing FIGS. 2 to 4A and also FIGS. 19 to 20A it becomes obvious that a length of the separation edge 17 is also smaller than a maximum height of the counter piece 9 measured transversely to the movement of the tuft picker 8.

In order for this length reduction of the separation edge 17 to be achieved, the counter piece 9 has at least one separation edge chamfer 25 that is oriented transversely to the longitudinal extent of the separation edge 17, or at least one separation edge arc 26, in the form of a radius, that is oriented transversely to the longitudinal extent of the separation edge 17, respectively. The separation edge 17 in terms of the length thereof is in this instance delimited both by the separation edge chamfer 25 as well as by the radius 26. According to FIG. 4A the counter piece 9 has two separation edge chamfers 25 that are oriented transversely to the longitudinal extent of the separation edge 17. Said separation edge chamfers 25 can be particularly readily seen in FIG. 4A. The separation edge 17 in this instance is disposed between the two chamfers 25 such that a length of the separation edge 17 is smaller than the height of the counter piece 9 measured transversely to the direction of movement of the tuft picker 8. If required, chamfer edges of the separation edge chamfers 25 can be rounded, in particular by way of a radius.

Figure 3:
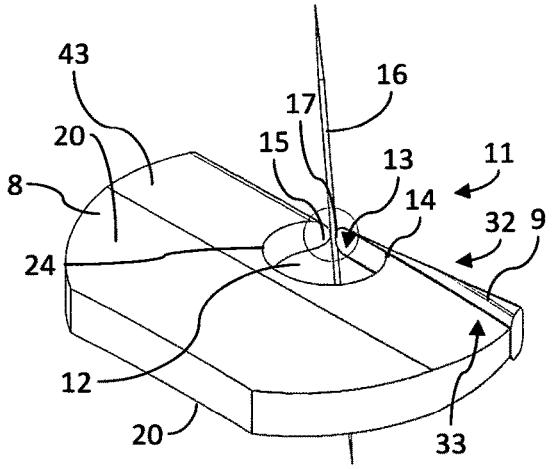
FIG. 3 shows a further perspective view of another embodiment of the tuft-picking device according to the invention, wherein the blade edge of the tuft-picking notch is delimited by two blade edge arcs or arcs that are disposed so as to be adjacent to the blade edge.
Figure 3A:
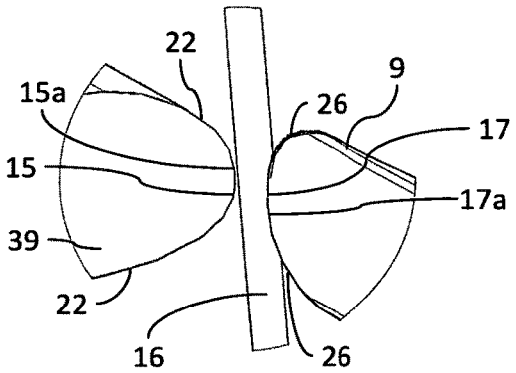
FIG. 3A shows the detail marked by a circle in FIG. 3 in an enlarged illustration, in which a separation edge of a counter piece of said tuft-picking device is configured so as to correspond to the blade edge of the tuft picker, wherein it can be seen that the blade edge and the separation edge have a straight profile that is oriented so as to be orthogonal to the direction of movement of the tuft picker.

FIGS. 3A and 4A show a further variant of the counter piece 9 according to the invention. It is provided herein that the counter piece 9 has two separation edge arcs 26 that are oriented transversely to the longitudinal extent of the separation edge 17, the separation edge 17 being disposed therebetween such that the length of the separation edge 17 is smaller than a maximum height of the counter piece 9 measured transversely to the direction of movement of the tuft picker 8, smaller than a maximum height of the tuft-picking notch 12, and smaller than a length of the bristle filament 16.

It is of course possible for the transition between the separation edge 17 and an upper side 27 and a lower side 28 between which the separation edge 17 is disposed to be bridged both by way of separation edge arcs 26 of this type as well as by way of separation edge chamfers 25 of this type. In particular in the use of separation edge chamfers 25 it is possible for chamfer edges of the separation edge chamfers 25 to be rounded, in particular to be provided with radii so as to achieve the transition which is ideally soft and gentle for the bristle filaments 16.

Figure 2:
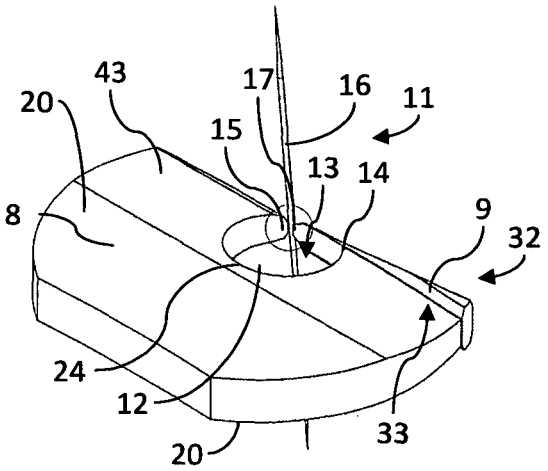
FIG. 2 shows a perspective view of a first variant of a tuft-picking device according to the invention, wherein it can be seen that a blade edge of the tuft-picking notch in terms of the length thereof is reduced by two blade edge chamfers that are disposed so as to be adjacent to the blade edge, and the tuft picker moreover has an upper-side and the lower-side picker chamfer.
Figure 2A:
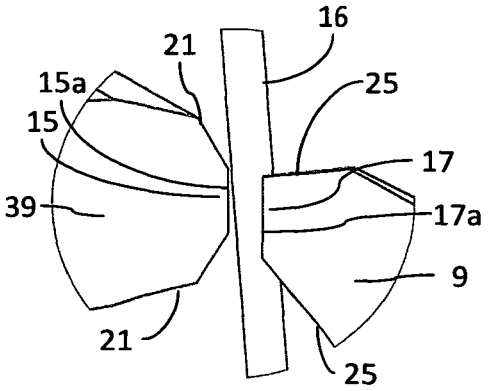
FIG. 2A shows the detail marked by the circle in FIG. 2 in an enlarged illustration, wherein it can be seen that a separation edge of the counter piece in terms of the length thereof is reduced according to the length of the blade edge by attaching in each case one upper-side and one lower-side separation edge chamfer.
Figure 19A:
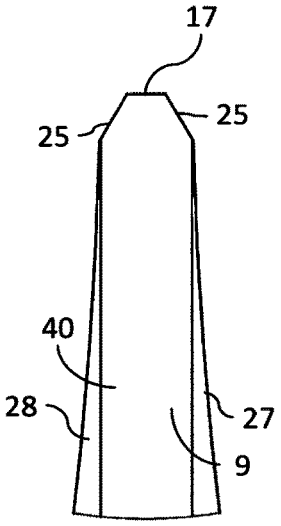
FIG. 19A shows the detail marked by the circle FIG. 19 in an enlarged illustration, wherein it can be seen that the separation edge is delimited by two separation edge chamfers.

FIGS. 2 to 4A as well as 19 to 19A show that at least one of the blade edges 14, 15 and the separation edge 17 are oriented orthogonally to a direction of movement of the tuft picker 8. This is also the case when the respective blade edge 14, 15, or the respective separation edge 17, respectively, is/are delimited on one side or else on both sides by blade edge chamfers 21 or separation edge chamfers 25, or blade edge arcs 22 or separation edge arcs 26, respectively (cf. FIG. 2A and FIG. 3A as well as FIG. 19A and FIG. 20A). The separation edge 17 illustrated in FIGS. 20 and 20A has a linear length between 0.01 mm and 0.8 mm, said length being disposed between the two separation edge arcs 26. This can hold true for any conceivable separation edge 17 in the context of the tuft-picking device 4 according to the invention.

An end side 29 that is aligned transversely to the front side 11 of the tuft picker 8 has an end face 30 which, depending on the exemplary embodiment of the tuft picker 8, is delimited by at least one peripheral end chamfer 31.

FIGS. 13 to 14A show tuft pickers 8, the end faces 30 thereof being in each case delimited by two peripheral end chamfers 31.

The peripheral end chamfers 31 herein can be aligned at an angle of 20 degrees to 30 degrees in relation to the end face 30 of the tuft picker 8, and have a chamfer width between 0.05 millimeters and 0.4 millimeters.

According to the exemplary embodiment of a tuft picker 8 as per FIGS. 14 and 14A, chamfer edges 31*a* of the end chamfers 31 in turn are rounded by way of a radius having a length between 0.005 millimeters and 0.03 millimeters.

FIGS. 17 to 18A highlight in particular that both a box side 32 of the counter piece 9 that faces the bristle supply 3 as well as a picker side 33 of the counter piece 9 that faces the tuft picker 8 have peripheral lateral chamfers 41 by way of which the respective interface 30 of the box side 32, or of the picker side 33, respectively, is delimited.

As has already been explained in the context of the afore-described exemplary embodiments of the tuft picker 8, it is also provided herein that the peripheral lateral chamfers 41 on the box side 32 of the counter piece 9 are aligned at an angle of 20 degrees to 80 degrees in relation to a lateral front face 40 of the box side 32 that is adjacent to the lateral chamfer 41. The peripheral lateral chamfers 41 on the picker side 33 of the counter piece 9 are also aligned at an angle of 20 degrees to 30 degrees in relation to a lateral front face 40 of the picker side 33 of the counter piece 9 that is adjacent to the lateral chamfer 41.

In the case of the exemplary embodiment of the counter piece 9 according to FIGS. 18 and 18A it can be seen that both the two lateral chamfers 41 disposed on the box side 32 as well as the lateral chamfers 41 disposed on the picker side 33 have chamfer edges 41*a* that are rounded by way of a radius. The length of said radius by way of which the chamfer edges are rounded herein is between 0.005 millimeters and 0.03 millimeters.

The chamfer width of the lateral chamfers 41 but also of the end chamfers 31 is between 0.05 millimeters and 0.4 millimeters.

Figure 9:
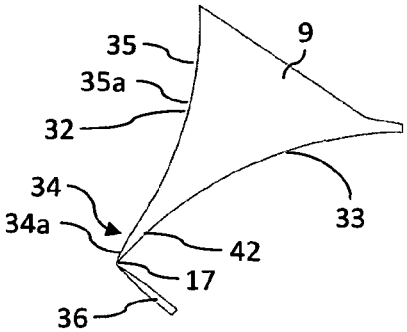
FIG. 9 shows a plan view of a counter piece according to the invention, wherein it can be seen that a box side of the counter piece is composed of a first portion having a first radius and of a second portion having a second radius that is bent counter to the first radius.
Figure 10:
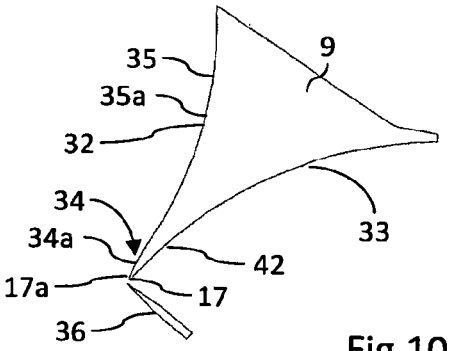
FIG. 10 shows a plan view of the counter piece illustrated in FIG. 9, after rounding the separation edge, wherein with the aid of the measuring tip illustrated therein it is highlighted that a tip of the counter piece on which the separation edge is disposed by virtue of the two dissimilar radii of the two portions of the box side of the counter piece is shortened only in a comparatively minor manner by rounding.

FIGS. 9 and 10 show that the box side 32 of the counter piece 9 that faces the bristle supply 3 is subdivided into a first portion 34 and into a second portion 35. The first portion 34 herein along the longitudinal extent thereof is bent about a first radius 34*a*. The second portion 35 along the longitudinal extent thereof is bent about a second radius 35*a*. The first radius 34*a* herein is bent in the direction counter to the second radius 35*a*. The separation edge 17 is configured on a free end 42 which can also referred to as the tip, of the first portion 34 on the counter piece 9. The second radius 35*a* herein is obviously larger than the first radius 34*a*.

Figure 7:
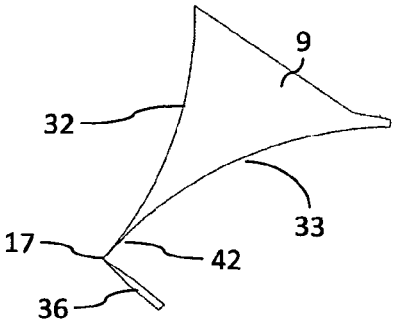
FIG. 7 shows a plan view of a conventional counter piece having a sharp, thus sharply tapered, separation edge on a tip of the counter piece.
Figure 8:
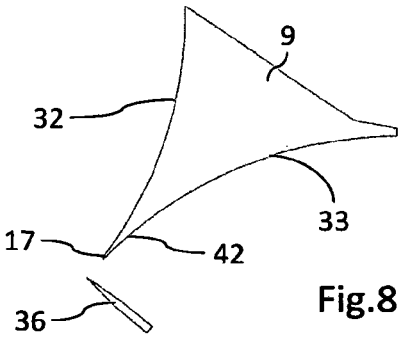
FIG. 8 shows a plan view of the counter piece illustrated in FIG. 7, after rounding the separation edge, wherein it can be clearly seen by a depicted measuring tip that a tip of the counter piece is severely shortened by rounding the separation edge.

FIGS. 7 and 8 show a counter piece 9 previously known from the prior art. In the case of said counter piece 9 it is provided at the box side 32 is curved in a first radius, and the picker side 33 is curved in a second radius. The separation edge 17 of said counter piece 9 is formed by the tangentially converging radii of the box side 32 and of the picker side 33. If the separation edge 17 is rounded, a relatively large spacing from the measuring tip 36 which is illustrated only for visualization purposes in FIGS. 7 to 10 is created. This by virtue of the voluminous subtraction of material which is required in order for the separation edge 17 of said counter piece 9 to be rounded.

This means that the separation edge 17 of said counter piece 9 due to the rounding thereof is retracted far, the free end 42 thus being shortened. This to an extent that the entire geometry of the tuft-picking device 4 has to be adapted.

In comparison, it can be seen by the position of the rounded separation edge 17 of the counter piece 9 according to the invention relative to the measuring tip 36 that a rounded feature of the separation edge 17 is associated with only a minimum change in the dimensions of the counter piece 9 and only a minimum shortening of the free end 42 of the counter piece 9 according to the invention, such that a new design of the tuft-picking device 4 due to the separation edge 17 being rounded is not required.

Depending on the requirement, the surfaces of the tuft picker 8 that face the material box 2 and also the surfaces of the counter piece 9 that face the tuft picker 8 can also be smoothed. A mean roughness value or surface roughness value Ra of the smoothed surfaces herein can be less than 0.1, preferably less than 0.05, particularly preferably less than 0.02. In principle, all of the surfaces of both the tuft picker 8 as well as of the counter piece can be smoothed in such a manner. It is moreover to be pointed out that also surfaces of the of the blade edge radius 15*a*, blade edge chamfers 21, of the separation edge radius 17*a* of the separation edge chamfers 25, of the end chamfers 31 and of the lateral chamfers 41, as well as of the blade edge arcs 22 and of the separation edge arcs 28 as well as radii for rounding the chamfer edges of the blade edge chamfers 21, of the separation edge chamfers 25, of the end chamfers 31 and of the lateral chamfers 41, but also upper-side and lower-side picker chamfers 43 on the tuft picker 8 can be smoothed in such a manner.

FIG. 41 shows a tuft picker 8 of the tuft-picking device 4 according to the invention, the tuft-picking notch 12 thereof being an adjustable tuft-picking notch 12. In order for said tuft-picking notch 12 to be adjusted, the tuft-picking device 4 comprises an adjustment device 37 for adjusting a notch depth and/or a cross-sectional geometry of the tuft-picking notch 12 which is disposed on the tuft picker 8. In order for the notch depth and/or the cross-sectional geometry of the tuft-picking notch 12 to be adjusted, an adjustment plate 38 can be pushed from behind into the tuft-picking notch 12 here.

FIGS. 22 to 39 show various embodiments of tuft pickers 8 according to the invention.

Figure 23:
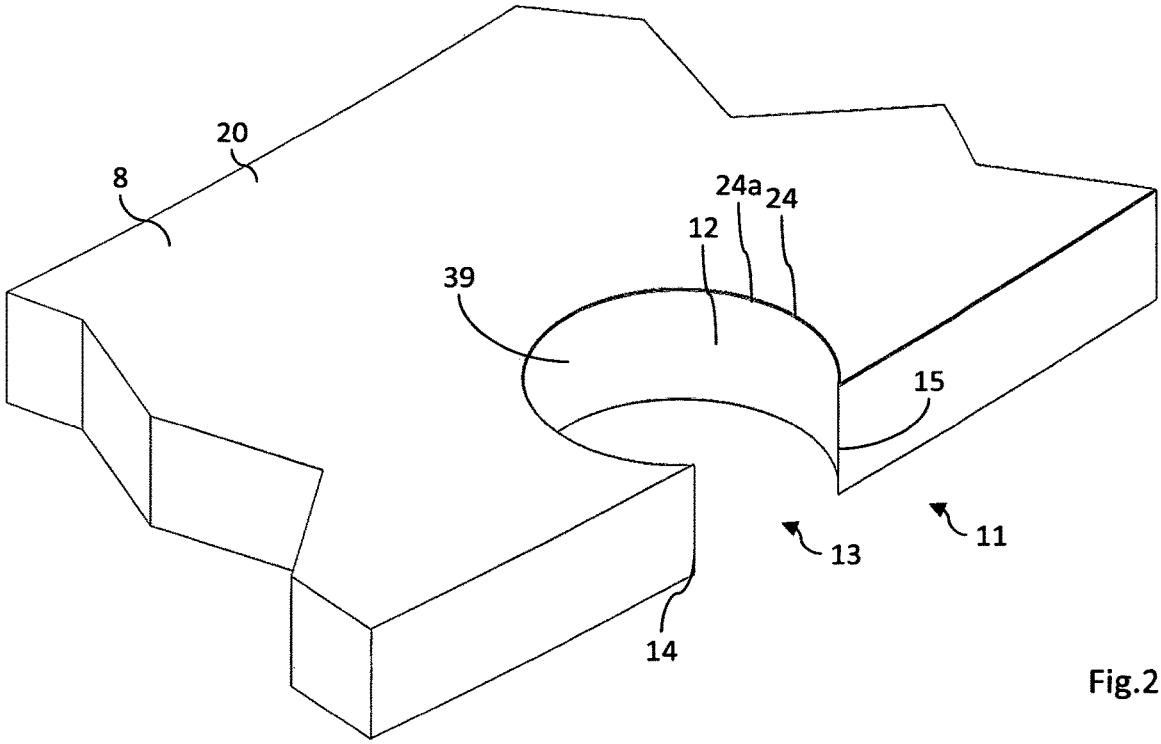
FIGS. 23 to 39 show various variants of tuft pickers housing tuft-picking notches, the blade edges thereof being delimited in terms of the length thereof by various combinations of blade edge chamfers and/or blade edge arcs as well as upper-side and/or lower-side picker chamfers that cover the tuft-picking notch.

FIG. 23 shows a tuft picker 8 having a tuft-picking notch 12, the notch edges 24 thereof being rounded by a notch edge radius 24*a*.

Figure 24:
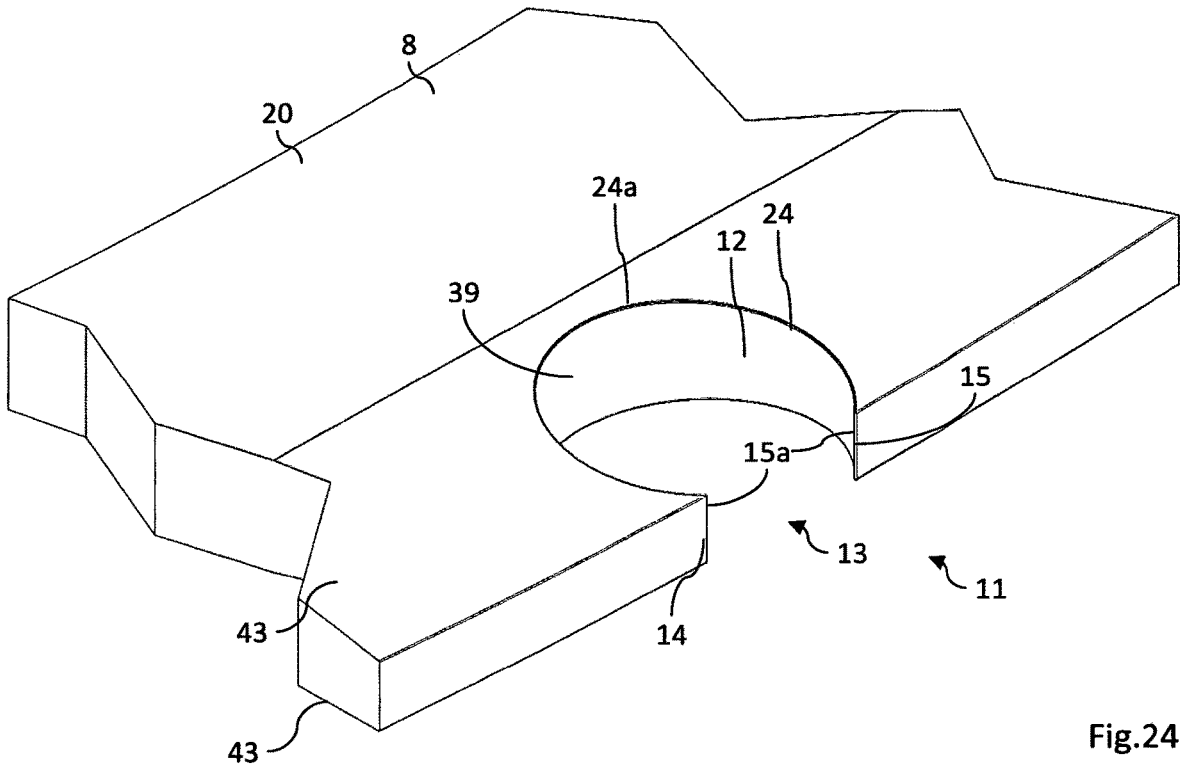

FIG. 24 shows a tuft picker 8, the two blade edges 14 and 15 thereof being rounded by a blade edge radius 15*a*. The notch edges 24 of said tuft picker 8 are likewise rounded by a notch edge radius 24*a*. The tuft-picking notch 12 is covered at least by one upper-side picker phase 43, the latter leading to a reduction of the edge length of the two blade edges 14 and 15 of said tuft picker 8.

Figure 25:
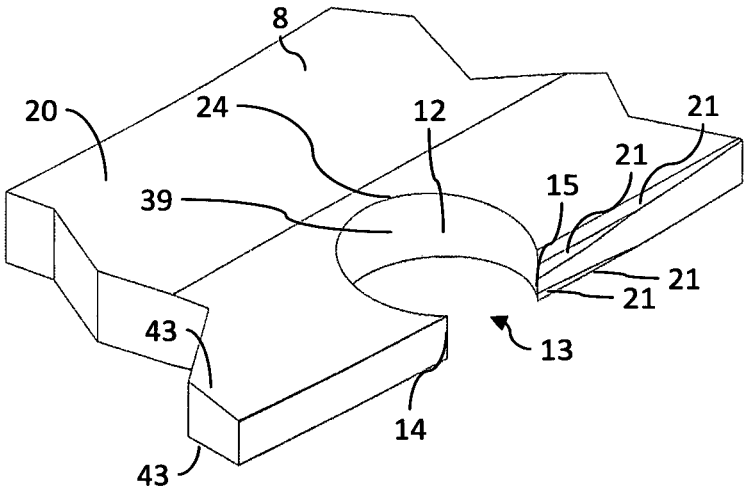

FIG. 25 shows a tuft picker 8, the rear blade edge 15 thereof being delimited on both sides by in each case two blade edge chamfers 21. The tuft-picking notch 12, at least on the upper side, is covered by a picker chamfer 43 also in the case of this tuft picker 8.

Figure 26:
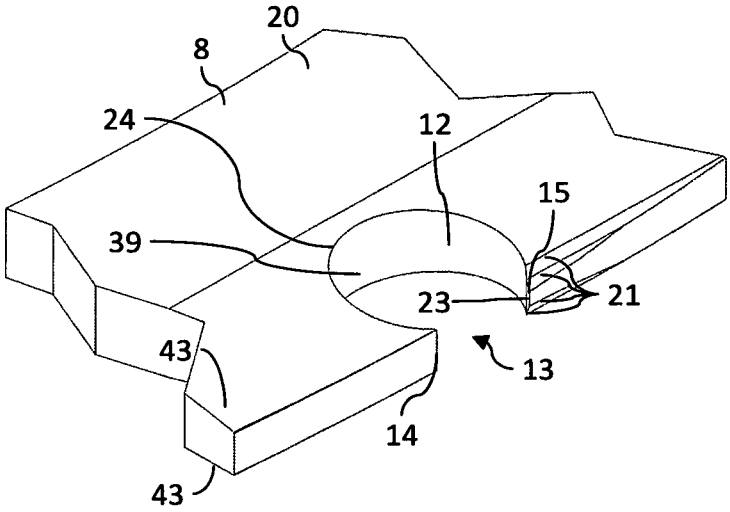

The tuft picker 8 according to FIG. 26 differs from the tuft picker 8 according to FIG. 25 by way of the run-in ramp 23 which is disposed so as to be adjacent to the rear blade edge 15 of said tuft picker 8.

Figure 27:
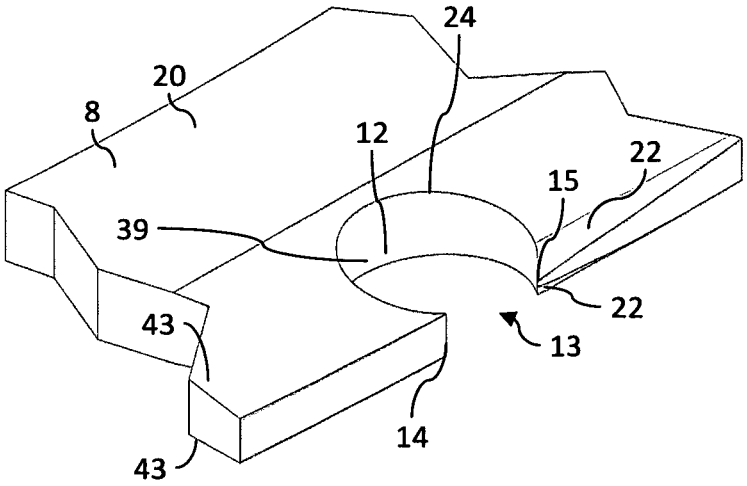

The tuft picker 8 according to FIG. 27 has at least one upper-side picker chamfer 43 which covers the tuft-picking notch 12 and thus leads to a reduction of the length of both the blade edge 14 as well as of the rear blade edge 15. Moreover, the rear blade edge 15 in the length thereof is delimited on both sides by in each case one blade edge arc 22.

Figure 28:
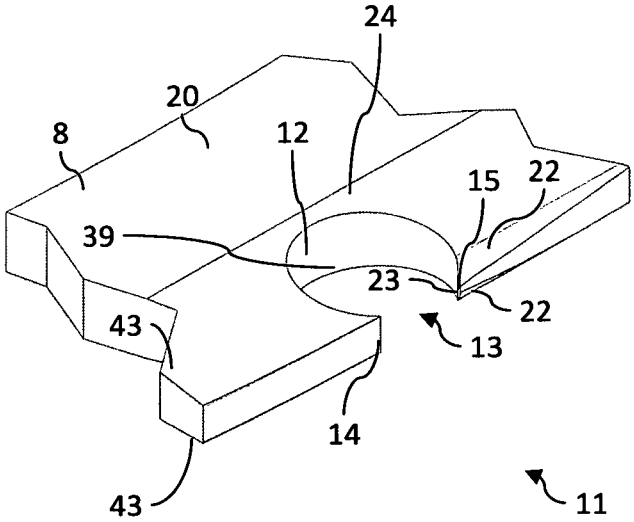

FIG. 28 shows a tuft picker 8 which differs from that of FIG. 27 by way of the run-in ramp 23 that is disposed so as to be adjacent to the rear blade edge 15.

Figure 29:
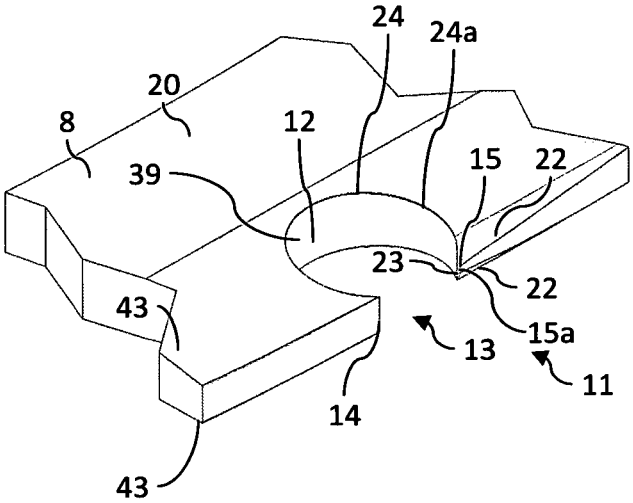

FIG. 29 shows a tuft picker 8 which in comparison to the tuft picker 8 such as is illustrated in FIG. 28 has notch edges 24 that are rounded by a notch edge radius 24*a* as well as a rear blade edge 15 that is rounded by a blade edge radius 15*a*.

Figure 30:
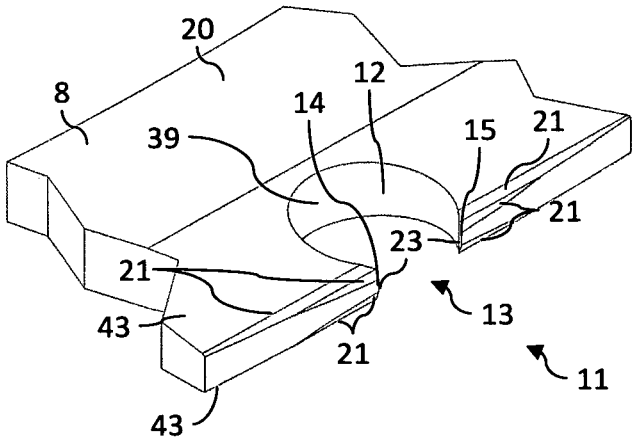

FIG. 30 shows a further tuft picker 8 which has an upper-side and a lower-side picker chamfer 43. The lengths of the two blade edges 14 and 15, in terms of the length thereof, are on both sides delimited by each case two blade edge chamfers 21. Moreover, run-in ramps 23 are in each case configured so as to be adjacent to the front blade edge 14 as well as to the rear blade edge 15.

Figure 31:
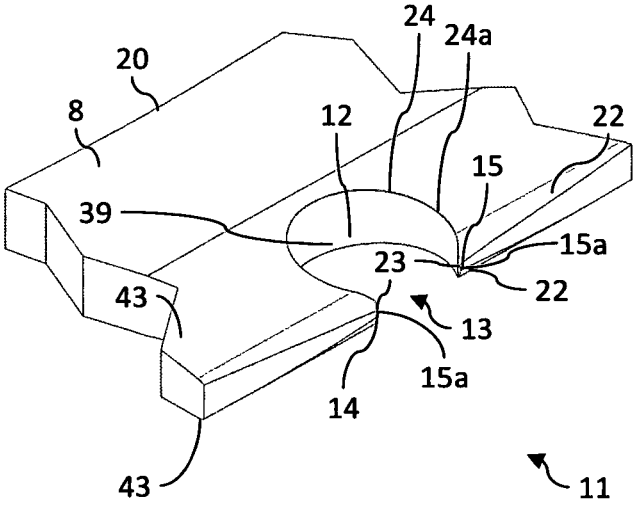

FIG. 31 shows a tuft picker 8 which has a picker chamfer 43 both on the upper side as well as on the lower side. Both blade edges 14 and 15 in terms of the length thereof are delimited in each case by two blade edge radii 22. A run-in ramp 23 into the tuft-picking notch 12 is in each case configured so as to be adjacent to the blade edge 14 and also so as to be adjacent to the blade edge 15 on said tuft picker 8.

Figure 32:
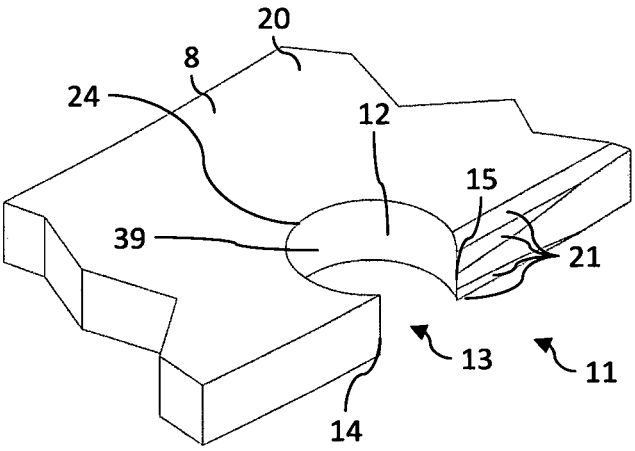

FIG. 32 shows a tuft picker 8 which has no picker chamfer whatsoever. The rear blade edge 15 of said tuft picker 8 in terms of the length thereof is on both sides delimited by in each case two blade edge chamfers 21.

Figure 33:
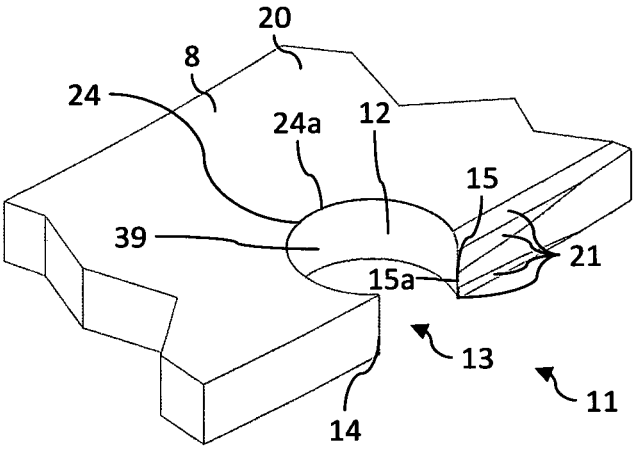

FIG. 33 shows a tuft picker 8 which differs from the tuft picker 8 such as is illustrated in FIG. 32 by way of the notch edges 24 that are rounded by a notch edge radius 24*a* and by way of the rear blade edge 15 that is rounded by a blade edge radius 15*a*.

Figure 34:
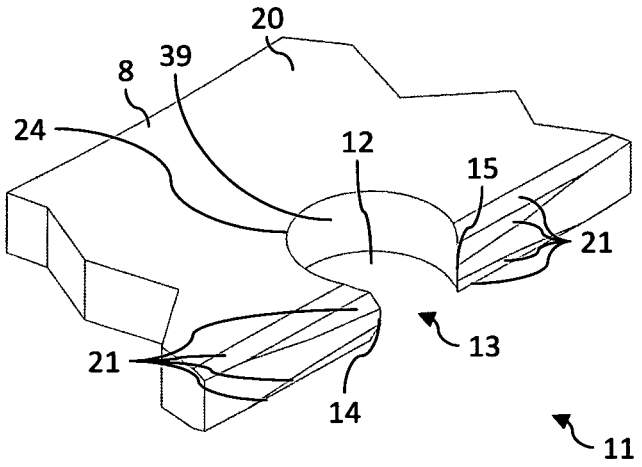

FIG. 34 shows a further tuft picker 8 which differs from the tuft picker 8 illustrated in FIG. 32 in that in the case of the former also the front blade edge 14 of the two blade edges 14 and 15 in terms of the length thereof is delimited on both sides by in each case two blade edge chamfers 21.

Figure 35:
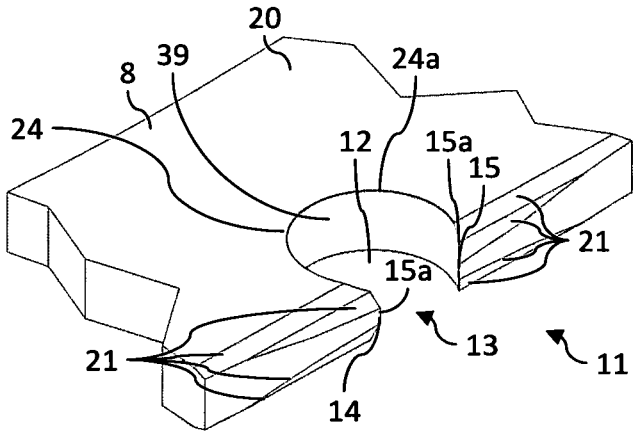

FIG. 35 shows a tuft picker 8 which is of the same construction as the tuft picker 8 illustrated in FIG. 34, wherein both the front blade edge 14 as well as the rear blade edge 15 of the tuft picker 8 are in each case rounded by way of a blade edge radius 15*a*. It is also worth noting that the notch edges 24 of this tuft picker 8 are rounded by a notch edge radius 24*a*.

Figure 36:
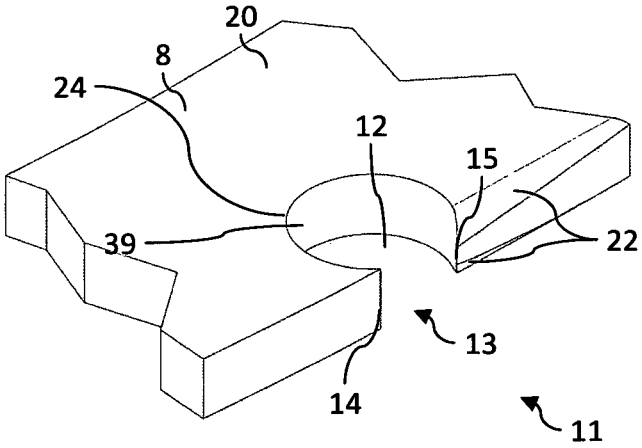

FIG. 36 shows a tuft picker 8, again without a picker chamfer 43, the rear blade edge 15 of said tuft picker 8 in terms of the length thereof being delimited on both sides by in each case one blade edge radius 22.

Figure 37:
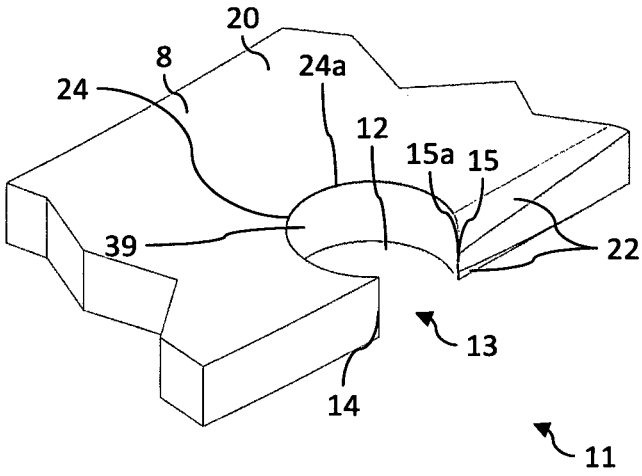

FIG. 37 shows a tuft picker 8 which differs from the tuft picker 8 which is illustrated in FIG. 36 by way of the notch edges 24 that are rounded by an notch edge radius 24*a* and by way of rear blade edge 15*a* that are rounded by a blade edge radius 15*a*.

Figure 38:
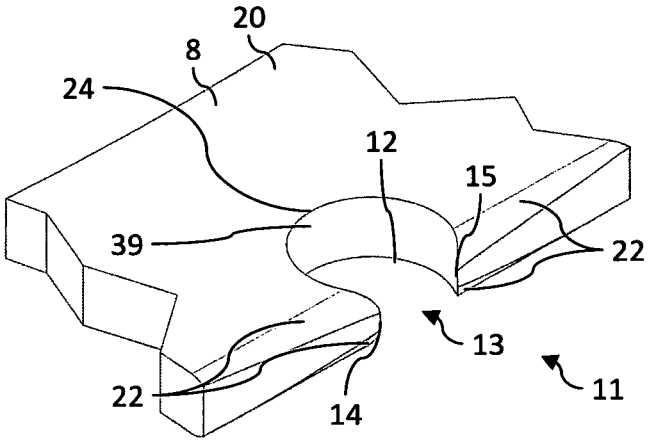

FIG. 38 shows a tuft picker 8, the front blade edge 14 thereof and the rear blade edge 15 thereof in terms of the lengths thereof being delimited in each case by two blade edge radii 22.

Figure 39:
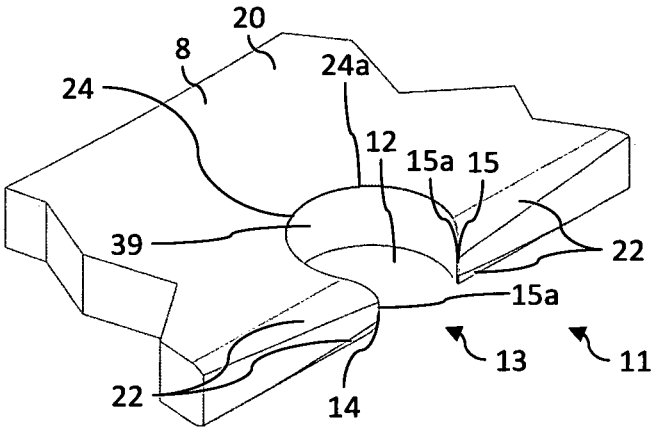

FIG. 39 shows a tuft picker 8 which differs from the tuft picker 8 according to FIG. 38 by way of the rounded notch edges 24 and the rounded rear blade edge 15, but is otherwise identical to said tuft picker 8 according to FIG. 38. The notch edges 24 are rounded by the already aforementioned notch edge radius 24*a*. The blade edges 14 and 15 are rounded by in each case one blade edge radius 15*a*.

The tuft-picking notch 12, the blade edges 14 and 15, the separation edge 17 and also all of the chamfers 21, 25, 31 and 41 on the tuft picker 8 on the tuft-picking notch 12 and on the counter piece 9 can be produced by HSC milling and/or HSC grinding. The smooth surfaces of the tuft picker 8, of the counter piece 9, and also the radii for rounding the at least one blade edge 14, 15 and the separation edge 17 are produced or at least post-machined by polishing. This can be performed in particular by friction grinding, flow grinding, plasma polishing, drag grinding, drag finishing and/or manual polishing and/or electrochemical deburring.

The radii for rounding existing chamfer edges, in particular the chamfer edges 31*a*, 41*a* can also be produced or at least post-machined by way of polishing methods of this type, when said chamfer edges are comparatively small.

The end face 30 on the tuft picker 8, and the lateral front faces 40 on the box side 32 and the picker side 33 of the counter piece 9, the chamfer faces of the end chamfers 31 and of the lateral chamfers 41 as well as surfaces of the chamfer edges 31*a* and 41*a* rounded by radii (cf. FIGS. 12A, 13A, 14A) and an internal face 39 of the tuft-picking notch 12 can also be produced in this way.

The chamfer faces of the end chamfers 31 and the end faces 30 of the tuft picker 8 according to FIG. 13A have a mean surface roughness value Ra of 0.1.

The chamfer faces of the end chamfers 31, the surfaces of the chamfer edges 31*a* rounded by radii, and the end faces 30 of the tuft picker 8 according to FIG. 14A have a mean surface roughness value Ra of 0.05.

The chamfer faces of the lateral chamfers 41, and the lateral front faces 40 of the counter piece 9 according to FIG. 17 have a mean surface roughness value Ra of 0.1.

The chamfer faces of the lateral chamfers 41, the surfaces of the rounded chamfer edges 41*a* and the lateral front faces 40 of the counter piece 9 according to FIG. 18A have a mean surface roughness value Ra of 0.05.

In principle, and depending on requirements, each chamfer and each surface, in particular those which come into contact with bristle filaments 16, of the tuft picker 8 and of the counter piece 9 can be smoothed.

At least the surface of the front side 11 of the tuft picker 8, the surfaces of the chamfers 21 and 25, as well as the surfaces of the radii 22 and 26 on the tuft picker 8, as well as the rounded chamfer edges by way of which the chamfers 21 and 25 can be delimited, are produced and/or post-machined by grinding and/or polishing.

The production or post-machining of at least said smooth surfaces of the tuft picker 8 and also of the counter piece can be performed specifically by friction grinding, flow grinding, plasma polishing, drag grinding, drag finishing and/or manual polishing and/or electrochemical deburring.

Wet and/or dry granules, porcelain grinding tools, plastics-material grinding tools, ceramic grinding tools, inox chips, copper pins, stainless-steel grinding tools, zirconium balls, micro-finishing grinding tools, plastics-material polishing tools, wet-grinding pastes, polishing pastes, walnut granules, corn granules, and/or dry-grinding granules are/is used as grinding or polishing means.

A run-in chamfer 44 for dispensing the bristle filaments 16 to the stuffing tool 5 can be seen at the lower end of the counter piece 9 depicted in FIG. 17.

As an improvement in the sector of brush manufacturing the tuft-picking device 4 is inter alia provided, said bundle-picking device 4 comprising the tuft picker 8 that is movable relative to the material box 2 of the brush-making machine 1, said tuft picker 8 on the front side 11 thereof that in the use position faces the bristle supply 3 kept ready in the material box 2 having at least one tuft-picking notch 12. The tuft-picking notch 12 comprises has two mutually opposite blade edges 14, 15 that delimit the notch opening 13 of the tuft-picking notch 12 and are oriented transversely to the direction of movement of the tuft picker 8. The counter piece 9 that is provided with the separation edge 17 that faces the tuft picker 8 is also part of the tuft-picking device 4. In order for an ideally gentle retrieval of bristle filaments 16 from the bristle supply 4 to be enabled, at least one of the two blade edges 14, 15 and/or the separation edge 17 is rounded.

LIST OF REFERENCE SIGNS

1 Brush-making machine
2 Material box
3 Bristle supply
4 Tuft-picking device
5 Stuffing tool
6 Holding device
7 Brush body
8 Tuft picker
9 Counter piece
10 Material holder
11 Front side of 8
12 Tuft-picking notch
13 Notch opening
14 Blade edge
15 Rear blade edge
15*a* Blade edge radius
16 Bristle filament
17 Separation edge
17*a* Separation edge radius
18 Arcuate separator
19 Tuft-picking disk
20 Flat side of 8
21 Blade edge chamfer
22 Blade edge arc
23 Run-in ramp
24 Notch edge
24*a* Notch edge radius
25 Separation edge chamfer
26 Separation edge arc
27 Upper side of 9
28 Lower side of 9
29 End side
30 End face
31 End chamfer on 30
31*a* Chamfer edge on 31
32 Box side of 9

33 Picker side of 9
34 First portion of 32
34*a* First radius
35 Second portion of 32
35*a* Second radius
36 Measuring tip
37 Adjustment device
38 Adjustment plate
39 Internal face of 12
40 Lateral front face on 32, 33
41 Lateral chamfer on 32, 33
41*a* Chamfer edge on 41
42 Free end of 34
43 Picker chamfer
44 Run-in chamfer on 9

The invention claimed is:

1. A tuft-picking device for a brush-making machine, the tuft-picking device comprising:

a tuft picker that is movable relative to a material box, a counter piece that is stationary relative to the movable tuft picker, at least one tuft-picking notch on the tuft picker located on a front side thereof that in a use position faces a bristle supply kept ready in the material box, and for picking a bristle tuft from the bristle supply and for dispensing a received bristle tuft to the brush-making machine using the at least one tuft-picking notch, the tuft picker is movable past the bristle supply and past the counter piece at least up to a dispensing position, the tuft-picking notch has two mutually opposite blade edges that delimit a notch opening of the tuft-picking notch and are oriented transversely to a direction of movement of the tuft picker, and the counter piece has a separation edge that faces the tuft picker, and at least one of the two blade edges or the separation edge is rounded transverse to a longitudinal extent thereof.

2. The tuft-picking device as claimed in claim 1, wherein at least one of the blade edges of the two blade edges is rounded, said blade edge being a rear blade edge in a transportation direction of bristle tufts to the dispensing position.

3. The tuft-picking device as claimed in claim 1 at least one of the blade edges or the separation edge is rounded with a respective one of a blade edge radius or a separation edge radius having a length between 0.005 mm and 0.03 mm.

4. The tuft-picking device as claimed in claim 1, wherein a surface of the at least one of the blade edges or the separation edge is smoothed with a mean roughness value or surface roughness value of Ra less than 0.1.

5. A method for producing a tuft picker of a tuft-picking device as claimed in claim 1, comprising at least one of HSC milling or HSC grinding at least one of the at least one tuft-picking notch, at least one blade edge chamfer, a blade edge arc, an end chamfer, an end radius, an upper-side picker chamfer, a lower-side picker chamfer on the tuft picker, a notch edge radius of the tuft-picking notch, chamfer edges of at least one chamfer on the tuft picker, or an internal face of the tuft-picking notch.

6. The method as claimed in claim 5, for producing a tuft picker of a tuft-picking device, further comprising producing at least one smooth surface of the tuft picker by at least one of grinding or polishing.

7. The method as claimed in claim 6, wherein a surface of at least one the blade edge radius, the blade edge chamfer, the blade edge arc, the notch edge radius, the end face, the end chamfer, the end radius, the chamfer edge of the at least one chamfer, or an internal face of the tuft-picking notch is at least one of produced or post-machined by the at least one of grinding or polishing.

8. The method as claimed in claim 7, further comprising performing the production or post-machining by at least one of friction grinding, flow grinding, plasma polishing, drag grinding, drag finishing, manual polishing, or electrochemical deburring.

9. The method as claimed in claim 5, further comprising using at least one of wet granules, dry granules, porcelain grinding tools, plastics-material grinding tools, ceramic grinding tools, inox chips, copper pins, stainless-steel grinding tools, zirconium balls, micro-finishing grinding tools, plastics-material polishing tools, wet-grinding pastes, polishing pastes, walnut granules, corn granules, or dry-grinding granules as grinding or polishing media.

10. A method for producing a counter piece of a tuft-picking device as claimed in claim 1, comprising:

at least one of a separation edge radius, a separation edge chamfer, a separation edge arc, a lateral front face, a lateral chamfer, a lateral radius or at least one rounded chamfer edge of a chamfer on the counter piece by at least one of HSC milling or HSC grinding.

11. The method as claimed in claim 10, further comprising producing or post machining at least one smooth surface of the counter piece by at least one of grinding or polishing.

12. The method as claimed in claim 11, wherein a surface of at least one of a separation edge radius, a separation edge chamfer, a separation edge arc, a lateral front face, a lateral chamfer, a lateral radius, or at least one chamfer edge of a chamfer on the counter piece is at least one of produced or post-machined by the at least one of grinding or polishing.

13. The method as claimed in 30, wherein the at least one of production or post-machining is performed by at least one of friction grinding, flow grinding, plasma polishing, drag grinding, drag finishing, manual polishing, or by electrochemical deburring.

* * * * *